United States Patent [19]

Nagashima et al.

[11] Patent Number: 4,884,222

[45] Date of Patent: Nov. 28, 1989

[54] FIRE ALARM SYSTEM

[76] Inventors: Tetsuya Nagashima, Tokyo; Eiji Matsushita, Yokohama; Sadataka Yuchi, Sagamihara; Akira Kitajima, Yokohama, all of Japan

[21] Appl. No.: 760,312

[22] Filed: Jul. 29, 1985

Related U.S. Application Data

[63] Continuation-in-part of Ser. No. 582,316, Feb. 22, 1984, abandoned.

[30] Foreign Application Priority Data

Jul. 31, 1984 [JP] Japan ..... 59-160850

[51] Int. Cl.[4] ..... G08B 17/00

[52] U.S. Cl. ..... 364/550; 340/588; 340/589; 340/628; 340/577; 364/185

[58] Field of Search ..... 364/550, 557, 555, 554, 364/185; 340/577, 588, 589, 584, 628

[56] References Cited

U.S. PATENT DOCUMENTS

| | | | |
|---|---|---|---|
| 3,728,615 | 4/1973 | Hill et al. | 340/589 X |
| 4,184,205 | 1/1980 | Morrow | 364/550 |
| 4,254,414 | 3/1981 | Street et al. | 340/627 |
| 4,316,179 | 2/1982 | Bliss et al. | 340/589 |
| 4,423,326 | 12/1983 | Ball | 250/339 |
| 4,459,583 | 7/1984 | van der Walt et al. | 340/589 |
| 4,472,715 | 9/1984 | Kern et al. | 340/587 |
| 4,581,604 | 4/1986 | Kimura et al. | 340/521 |
| 4,796,205 | 1/1989 | Ishii et al. | 364/550 |
| 4,803,469 | 2/1989 | Matsushita | 340/577 |

*Primary Examiner*—P. S. Lall
*Assistant Examiner*—Thomas G. Black

[57] ABSTRACT

A fire alarm system of the present invention is adapted to compute an approximation equation based on the detection data from a detector or detectors such about a smoke density, a temperature, a gas concentration, etc. and predictively determine a fire based on the approximation equation. The system including computing section for computing an approximation equation approximating a change in the physical phenomenon related to the occurrence of a fire which is output from the detector or detectors, sequentially sampled and stored and for computing a future value of the phenomenon estimated from the approximation by using a predetermined number of the data stored in a storing section. The future vale is compared with a data value preliminarily set in association with the fire alarming and an alarm is generated when the relation therebetween is not within a predetermined range.

22 Claims, 23 Drawing Sheets

Detecting Means
Transmitting Circuit
Receiving Circuit
A/D Converting Circuit
Storing Circuit
Average Computing
Difference Computing Circuit
Difference Decission Circuit
Approximate-equation Computing Circuit
Degree-of Danger Decision Circuit
Alarming Circuit
1a
1b
1n
2
3
20
21
22
23
24
25
26
27
28
29

(a)

(b)

(C)

FIRE ALARM SYSTEM

CROSS REFERENCE TO RELATED APPLICATION

This is a continuation-in-part application of patent application Ser. No. 582,316 filed on Feb. 22, 1984 now abandoned.

BACKGROUND OF THE INVENTION

1. Field of the Invention

This invention relates to a fire alarm system and more particularly to a fire alarm system which is capable of computing and preestimating, on the basis of analog data, such as a temperature, a density of CO gas, or a density of smoke detected by a fire detector or detectors, a degree of danger which will threaten the people in the near future, so as to give an alarm preliminarily when the estimated degree of danger is above the predetermined level.

2. Relevant Arts

Recently, an analog intelligent fire alarm system in which a central signal station receives detection data from an analog type detector and makes a fire determination based on the detection data has been researched and developed.

Heretofore, there have been proposed, for example, a system in which the detection data obtained continuously from the analog type detector is compared with a predetermined threshold value to determine a fire and a system in which an amount of a change in the detection data from the analog type detector is computed every predetermined period to make a fire determination when the amount of the change exceeds a predetermined value.

These systems, however, involve such a problem that they are easily influenced by transitory noises.

In addition, it is difficult for the fire alarm systems of this type to grasp a spreading tendency of a fire. For instance, there is a serious problem in case of a flaming fire which develops abrupt temperature rise after a certain period of time from the start of a fire. In this case, sometimes, the fire has spreaded when the central signal station makes a fire determination and the escape from the fire is started only after the fire becomes very dangerous for people.

SUMMARY OF THE INVENTION

The present invention has been made to obviate the problems as described above and it is an object of the present invention to provide a fire alarm system which is capable of preventing an errorneous fire alarming and giving early alarming for a dangerous fire.

It is an object of the present invention to provide a fire alarm system which is capable of enabling proper guidance for escape coped with the course of the fire progress and the degree of urgency by computing and preestimating a time necessary to reach the level which is dangerous to the people, based on the data of a change in the physical phenomena of the surroundings, comparing the time required to reach the dangerous level with a time required for escape and generating a fire alarm in relation with the time for escape.

It is an another object of the present invention to provide a fire alarm system which computes and preestimates a future data level in after past predetermined time from present based on the data of a change in the physical phenomena of the surroundings.

It is another object of the present invention to provide a fire alarm system which is capable of eliminating a delay of the data processing by presetting a level for starting computation for determination of a fire, and starting such computation by calculating a degree of danger based on all the data from the beginning only when the detection data is as high as said level. As a result, the computation can be omitted within a range where the data is determined not to be a fire so as to make computation only within the range where the data is determined to be fire.

It is a further object of the present invention to provide a fire alarm system wherein a fire level is set as well as a dangerous level which is determined as dangerous to the people, so that it may generate an alarm when the degree of danger threatening the people on a fire spot, which is computed from the detected data, is below said dangerous level but it exceeds the fire level.

In the fire alarm system of the present invention, a change in data related to a fire such as a smoke density which is sampled every predetermined period is detected and the data related to the change is approximated by a regression line so as to relate the future tendency of the data to a fire alarm. For these purposes, the system of the present invention comprises detecting means for detecting a change in physical phenomenon of the surroundings due to the start of a fire and outputting analog data corresponding to the change; data sampling for sampling the data for the detecting means; storing means for storing the data output from the data sampling means for said or each of said detecting sections; an operation unit for computing and preestimating a time required to reach the level which is judged as dangerous to the people, based on the detection data sampled periodically; and a comparing means for comparing the computed and preestimated time required to reach said level with a time necessary for escape from a fire spot which decides the degree of danger exceeds an allowable level when the time for escape is shorter than the computed and preestimated time and generates an alarm.

In accordance with the preferred embodiment of the invention a fire alarm system is characterized in that it converts detection data into an approximation equation to carry out the computation and preestimation by the functional approximation method using linear, quadratic or higher degree equations.

DESCRIPTION OF THE PREFERRED EMBODIMENTS

Figure 1A:
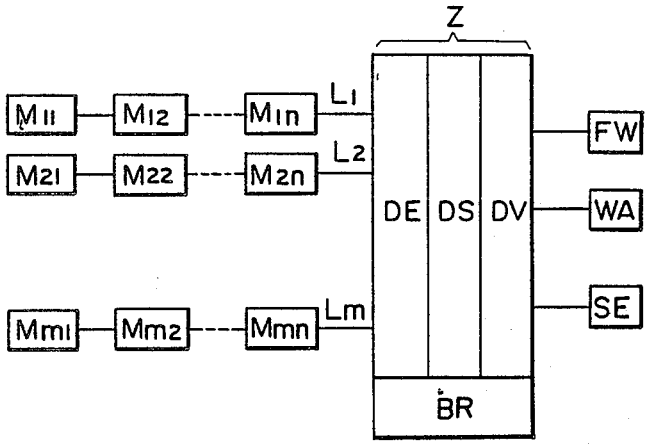
PRIOR ART Fig 1A
FIG. 1A is a block diagram of the fundamental formation of a conventional fire alarm system.

Some preferred embodiments of the present invention will now be described referring to the drawings.

There has been proposed by prior art, for example Japanese Patent Application Publication No. 57-15437, German Pat. No. DAS 2,341,087 and Swiss Pat. No. 575629, fire alarm systems having a formation as shown in FIG. 1A and which operate as shown in FIG. 1B.

In general, such prior conventional fire alarm systems operate in such a manner that the signal station thereof receives an analog fire detection signal transmitted by the fire detector or detectors upon detection of a fire and compares the fire detection signal with a preset threshold level to determine if the signal represents a fire. When the signal exceeds the preset level, the system gives an alarm. These systems, however, involve problem of possibly generating an erroneous fire alarm signal by a noise because they generate a fire alarm signal whenever the detection signal is above the preset level.

More specifically, as shown in FIG. 1A this type of fire alarm system is comprised of fire detectors $M_{11}$–$M_{mn}$ each equipped with signal means for continuously or periodically transmitting signals specifying themselves respectively and signals representing momentary information conditions, and a central signal station Z comprising means for identifying and storing the detector signals which are periodically collated, a comparing means for confirming a change with time of the conditions of the detectors and a logical operation circuit for obtaining an information decision criterion differentiated from the change with time of signals from one or plural detectors.

Figure 1B:
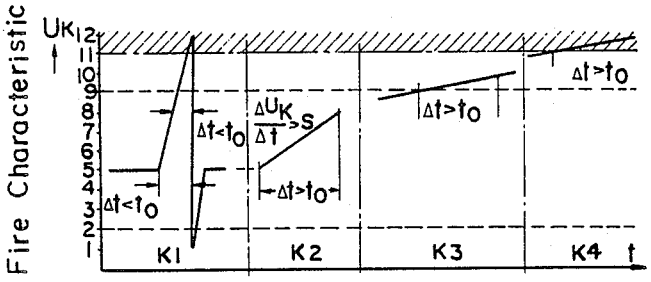
PRIOR ART Fig 1B
FIG. 1B is a diagram showing determination criterion of a fire characteristic.

This fire alarm system operates as shown in K1 to K4 of FIG. 1B. In the case of K1, the fire characteristic value Uk changes abruptly in a short time for example by thunderbolt, but the time length of the change $\Delta t$ is shorter than the observation time period $t_o$, so that the detector information condition is decided as being normal and no alarm is given. In the case of K2, the fire characteristic value is varied, within the observation period, monotonously at a predetermined slope $$\left(\frac{\Delta Uk}{t} > S\right)$$

and an alarm is given. In the case of K3, the fire characteristic value Uk is within the hazard range (9 to 11) throughout the observation time period and an alarm is given. In the case of K4, as in K3, the fire characteristic value is continuously above the alarm level 11 throughout the observation time period and an alarm is given. The normal operation range of the fire alarm system is within 2 to 11.

This fire alarm system, however, only functions to determine whether a fire has started or not and cannot preestimate, based on the detection results, a degree of danger which will threaten people in the not distant future. For this reason, suitable action against a fire which corresponds with the progress of the fire, e.g. guidance for escape, cannot always be taken.

There will now be described a first embodiment of the present invention.

Figure 3:
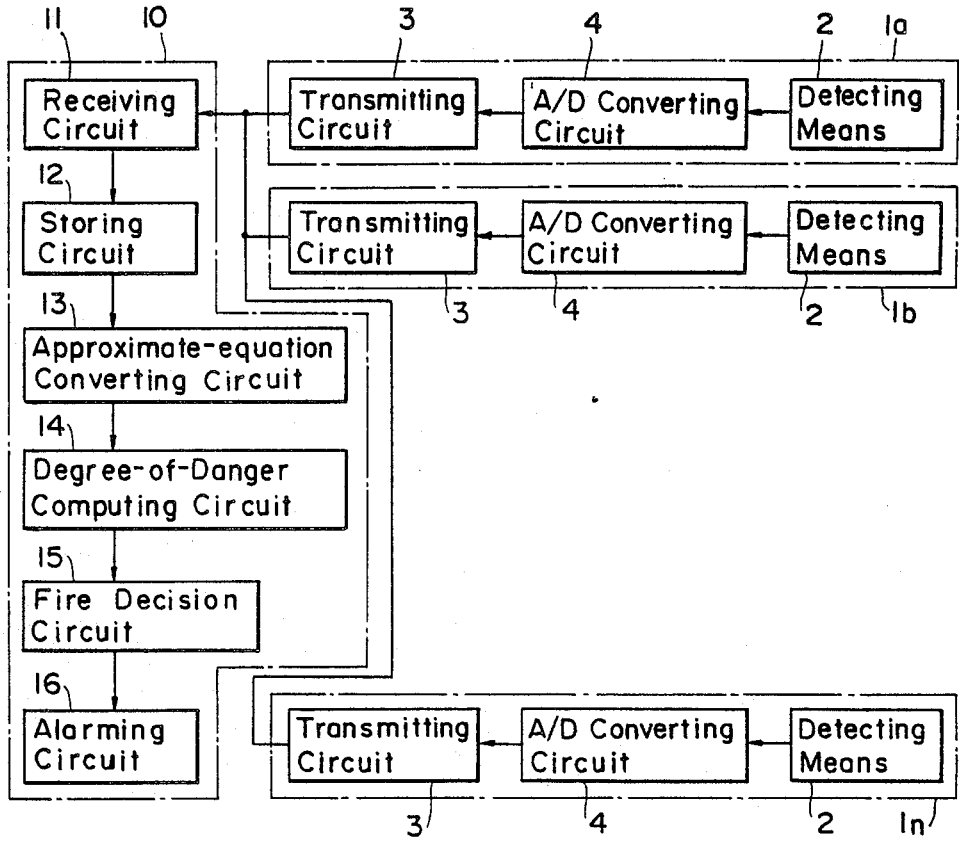
FIG. 3 is a block diagram of a first embodiment of the present invention.

FIG. 3 is a block diagram of a fire alarm system of the first embodiment of the present invention.

This embodiment of the present invention is so constructed that it converts changes in the physical phenomena of the surroundings into a multi-degree approximation equation based on analog detection data of temperature, densities of smoke and CO gas detected by an analog fire detector, and derives a degree of danger by an approximation equation so as to generate a fire alarm when the degree of danger is above a preset level.

Figure 2:
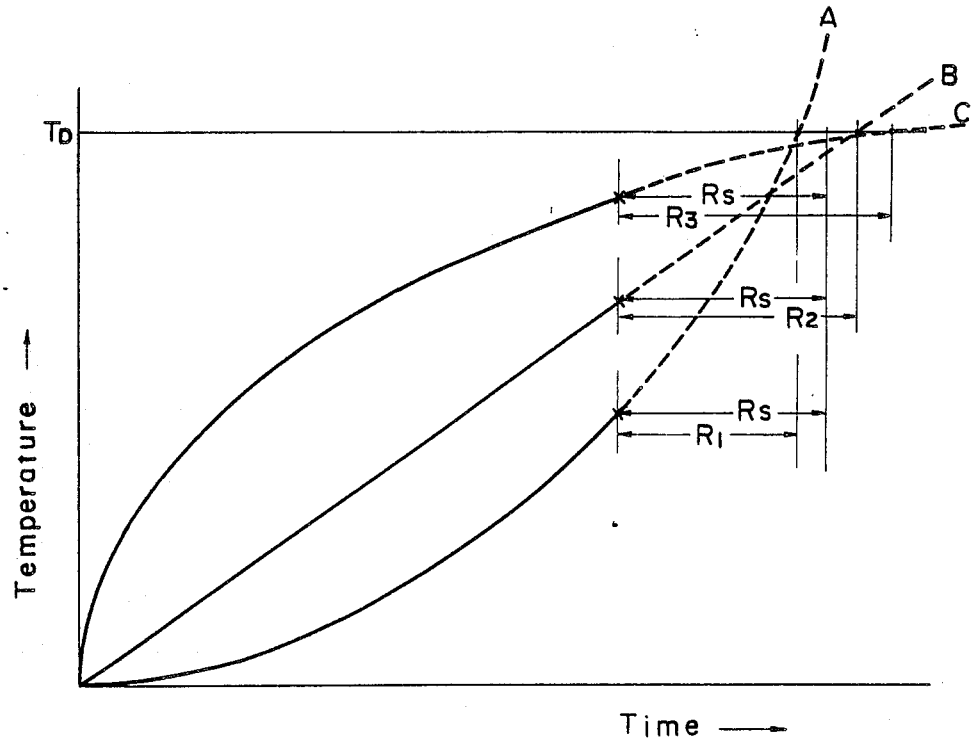
FIG. 2 is a diagram of the detection data detected by analog type fire detectors.

The term "degree of danger" is used here to mean a time which is required for the surrounding condition to reach a certain dangerous condition to people. For example, as to the temperature, a dangerous temperature $T_D$ is set for the surrounding condition which is dangerous to people as shown in FIG. 2, and the times $R_1$, $R_2$ and $R_3$ required to reach the dangerous temperature $T_D$ are defined as the degrees of danger of the fires A, B and C, respectively. Therefore, the smaller of the value of the degree of the danger, the larger the degree of danger to the people becomes.

A threshold level $R_s$ which is a reference value for the determination of the degree of danger, is defined as the time necessary for escape from the spot of fire and is determined by considering the various conditions surrounding the spot of fire.

In FIG. 3 numerals 1*a*,1*b*, . . . 1*n* each designates a fire and produces a signal detector which detects a fire in analog form in proportion to the changes in the physical phenomena of the surroundings caused by a fire. Each of the fire detector comprises a detectors means 2 for detecting temperature and densities of gas or smoke, an A/D converter 4 for converting the analog value detected by the detector means 2 into a digital value and a transmission circuit 3 for transmitting the digital data. Numeral 10 designates a central signal station having a microcomputer and connected to the plural fire detectors 1*a*, 1*b* . . . 1*n* by signal lines. 11 is a receiving circuit for sequentially sampling, at certain time intervals, the A/D converted analog detection data from the respective fire detectors 1*a*, 1*b* . . . 1*n* and also identifying them. The detection data received by the receiving circuit 11 are input to a storing circuit 12 and stored there with respective addresses. 13 is an approximate-equation converting circuit for converting the stored contents in the storing circuit 12 into an approximation equation. The approximate-equation converting circuit 13 is connected to a degree-of-danger computing circuit 14 where the stored contents is computed to determine the degree-of-danger. The so obtained value of the degree of danger is compared with a predetermined alarm reference value to allow a fire determining circuit 15 to determine a fire condition which generate an output to drive an alarming circuit 16 formed of an alarm lamp and buzzer.

Figure 4:
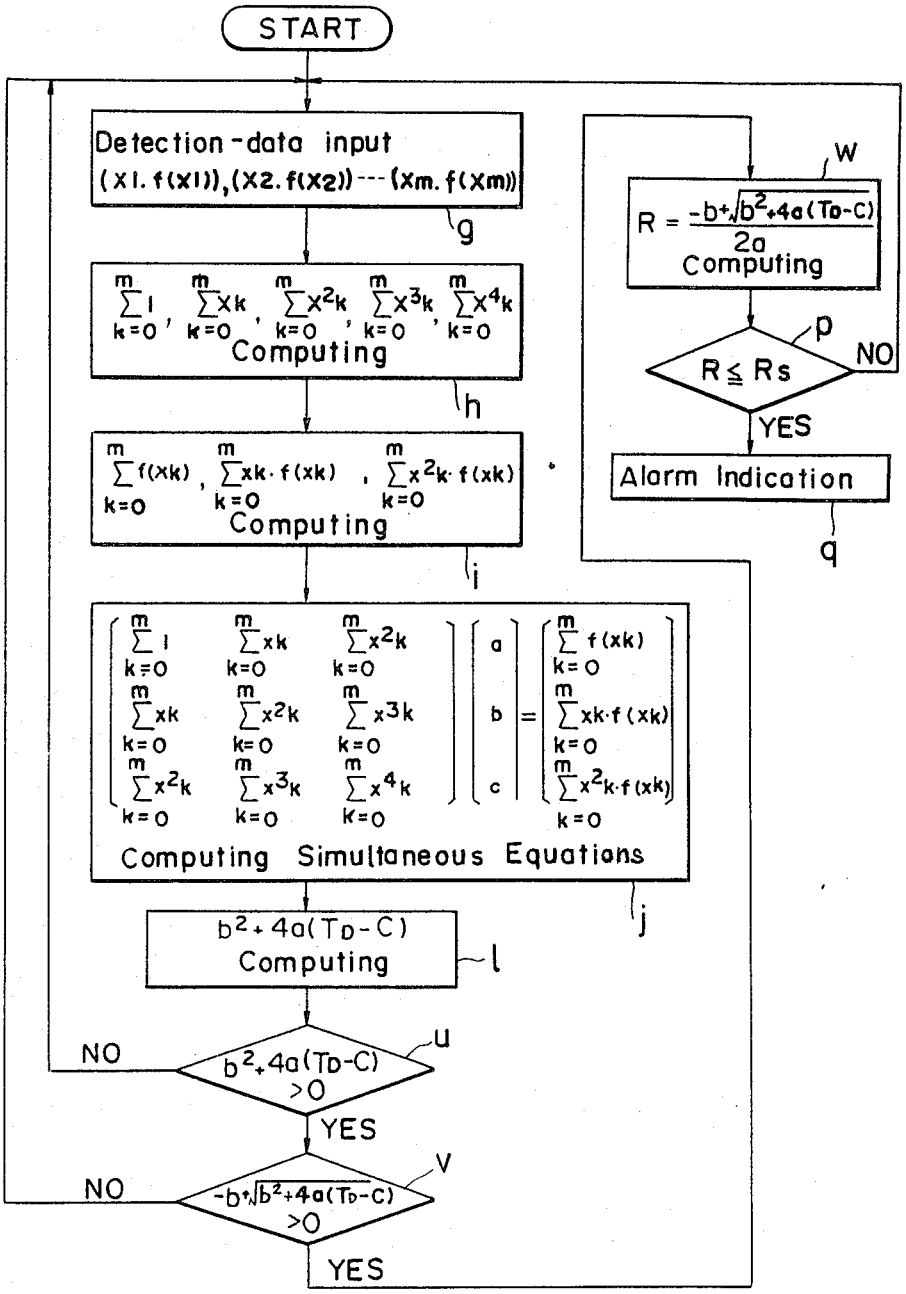
FIG. 4 is a program flowchart of the embodiment shown in FIG. 3.

FIG. 4 is a program flowchart of the approximate-equation converting circuit 13, the degree-of-danger computing circuit 14 and the fire determining circuit 15. The operation of the fire alarm system of FIG. 3 will now be described referring to the program flowchart.

The detection data from the fire detectors 1*a*, 1*b* . . . 1*n* are sequentially received, at predetermined time intervals, by the receiving circuit 11 while being identified with respect to the fire detectors. Now let m detection data D1 ,D2, . . . ,Dm from the fire detector 1*a* be:

$$(x_1, f(x_1))(x_2, f(x_2)) \ldots (x_m, f(x_m))$$

where $x_1, x_2 \ldots x_m$ each represent a detection time and $f(x_1), f(x_2) \ldots f(x_m)$ each represent an analog value at such detection time. These detection data $(x_1, f(x_1))(x_2, f(x_2)) \ldots (x_m, f(x_m))$ are stored by the storing circuit 12 and input to a block g. Blocks h, i, and j show the process of conversion of the m detection data into a quadratic approximation equation. The method of working out the simultaneous equations as shown in block j based on the m detection data will be explained using the method of least squares. Now, letting data functions obtained from the m detection data $(x_1, f(x_1))(x_2, f(x_2)) \ldots (x_m, f(x_m))$ be f(x), the quadratic approximation F(x) of the data function f(x) is expressed as follows:

$$F(x)=ax^2+bx+c \tag{1}$$

where a, b and c are coefficients, respectively.

In order to obtain the approximation equation F(x) of the data function f(x) there may be obtained the coefficients a, b and c of the F(x) which minimize the following formula $$\int (F(x)-f(x))^2\,dx$$

may be obtained. However, the actual data function f(x) is not a continuous one and is obtained in the form of n discrete values and if function Q(a, b, c) of a, b and c is expressed by $$Q(a,b,c) = \sum_{k=0}^{m} (F(x_k) - f(x_k))^2 \tag{2}$$

such a, b and c as make the Function Q(a, b, c) minimized may be obtained. Therefore, $$\left.\begin{aligned} \frac{\partial Q}{\partial c} &= \sum_{k=0}^{m} 2\{F(x_k) - f(x_k)\}\cdot 1 = 0 \\ \frac{\partial Q}{\partial b} &= \sum_{k=0}^{m} 2\{F(x_k) - f(x_k)\}\cdot x_k = 0 \\ \frac{\partial Q}{\partial a} &= \sum_{k=0}^{m} 2\{2F(x_k) - f(x_k)\}\cdot x_k^2 = 0 \end{aligned}\right\} \tag{3}$$

The equations (3) is rewritten into $$\left.\begin{aligned} \sum_{k=0}^{m} F(x_k)\cdot 1 &= \sum_{k=0}^{m} 1\cdot f(x_k) \\ \sum_{k=0}^{m} F(x_k)\cdot x_k &= \sum_{k=0}^{m} x_k\cdot f(x_k) \\ \sum_{k=0}^{m} F(x_k)\cdot x_k^2 &= \sum_{k=0}^{m} x_k^2\cdot f(x_k) \end{aligned}\right\} \tag{4}$$

Since $F(x)=ax^2+bx+c$, the following simultaneous equations are obtained from (1) and (4).

$$\begin{bmatrix} \sum_{k=0}^{m} 1 & \sum_{k=0}^{m} x_k & \sum_{k=0}^{m} x_k^2 \\ \sum_{k=0}^{m} x_k & \sum_{k=0}^{m} x_k^2 & \sum_{k=0}^{m} x_k^3 \\ \sum_{k=0}^{m} x_k^2 & \sum_{k=0}^{m} x_k^3 & \sum_{k=0}^{m} x_k^4 \end{bmatrix} \begin{bmatrix} c \\ b \\ a \end{bmatrix} = \begin{bmatrix} \sum_{k=0}^{m} f(x_k) \\ \sum_{k=0}^{m} x_k f(x_k) \\ \sum_{k=0}^{m} x_k^2 f(x_k) \end{bmatrix} \tag{5}$$

In block h, each value of $$\sum_{k=0}^{m} 1,\ \sum_{k=0}^{m} x_k,\ \sum_{k=0}^{m} x_k^2,\ \sum_{k=0}^{m} x_k^3 \text{ and } \sum_{k=0}^{m} x_k^4$$

of the left side of (5) is computed from the detection data of the block g and in block i, each value of the right side of the formula (5), i.e.

$$\sum_{k=0}^{m} f(x_k),\ \sum_{k=0}^{m} x_k f(x_k), \text{ and } \sum_{k=0}^{m} x_k^2 f(x_k)$$

is computed from the detection data of the block g. In block j, the simultaneous equations (5) is calculated by the Gauss - Jordan method from the left side of (5) computed in the block h and the right side of (5) computed in the block i to obtain the coefficients a, b and c of the quadratic function $F(x)=ax^2+bx+c$ which is the approximation equation of the data function f(x).

Blocks 1, u, v, and w show the process for calculating the degree of danger R based on the values a, b and c obtained in the block j. The method for computing the degree of danger R is as follows:

Now letting the dangerous temperature which makes the surrounding dangerous to the people by $T_D$, since the degree of danger R is a time required to reach the dangerous temperature $T_D$, the degree of danger R is obtained by solving the following equation:

$$F(x)=T_D \tag{6}$$

More specifically, the equation (6) is substituted for the equation (1), and there is obtained:

$$ax^2+bx-(T_D-c)=0 \tag{7}$$

Since the degree of danger R is a value obtained from the equation (7) solved for x which is a time required to reach the dangerous temperature $T_D$, it may be obtained as follows:

$$R=\frac{-b\pm\sqrt{b^2+4a(T_D-c)}}{2a} \tag{8}$$

Therefore, by substituting the value of the dangerous temperature $T_D$ preliminarily set and the values of the coefficients a, b and c of the quadratic approximation equation F(x) obtained by the block j, for the equation (8), the value of the degree of danger R may be calculated.

The determination of the degree of danger R will now be explained.

After the values of the coefficients a, b and c have been obtained by the calculations in the blocks h, i and j, the following formula $$b^2+4a(T_D-c) \tag{9}$$

is calculated in the block 1 and the obtained value is subjected to the determination in the block u as to the following:

$$b^2+4a(T_D-c) \tag{10}$$

It suffices to continue the calculation only when the value of the degree R of danger is a real number in (8), i.e. the value of (9) becomes a positive number. Therefore, if (9) is a negative number like the detection data of curve C in FIG. 2, the block g is resumed again after the determination in the block u to extract the detection data of predetermined time period from the respective fire detectors 1*a*, 1*b* . . . 1n.

Although the approximation equation computed based on the analog detection data from the analog fire detector is a quadratic function, an approximate equation of cubic or more degrees may be employed. In the latter case, more accurate degree of danger can be obtained.

The A/D converting circuit may be incorporated into the central signal station instead of being provided in the respective fire detectors. In this case, the circuit arrangement of the fire detector can be simplified and rendered small sized. An erasing circuit for erase the analog detection data of below a predetermined level may be provided in the signal station to allow the capacity of the storing circuit to be smaller.

The degree-of-danger computing circuit in said embodiment employs an method which computes a quadric regression equation by approximation equation. alternatively be such that it obtains the degree of danger in the form of a difference value of difference in the detection data as will be described in detail later. The difference value is used herein to mean a value obtained by substituting the difference in the detection data for a difference equation.

A second embodiment of the present invention will now be described with reference to FIG. 5.

The second embodiment is so formed that it obtains the detection data such as temperature, densities of CO gas or smoke which are detected by the detectors, in the form of a difference value. Such difference value is compared with a first threshold level and a second threshold level. An alarm is given when the difference value exceeds the second threshold. When the detection data is below the first threshold it is cancelled in order to reduce the burden on the computing processing operation of the central signal station. The detection data from the detector is converted into an approximation equation when the difference value exceeds the first threshold level but is below the second threshold level, and a degree of danger is determined from the approximation equation in order to make a fire determination.

Figure 5:
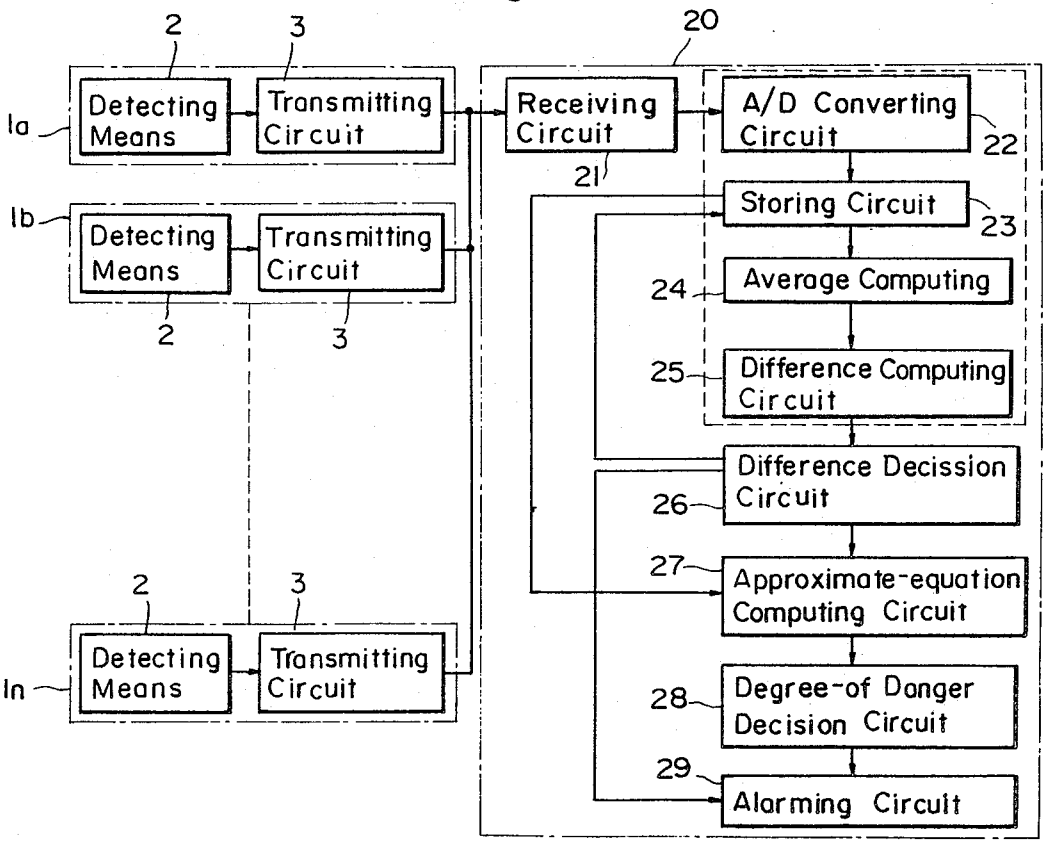
FIG. 5 is a block diagram of a second embodiment of the present invention.

In FIG. 5, 1*a*, 1*b* . . . 1*n* are fire detectors are detecting, in analog form, a change in physical phenomenon of the surroundings caused by occurrence of a fire. Each of the detectors comprises a detecting means 2 for detecting a temperature, a density of a CO gas or smoke and a transmission circuit 3 for transmitting the detected data detected by the detecting means 2. 20 is a central signal station including a microcomputer therein for carrying out computing processing operation based on the detection data from the fire detectors 1*a*, 1*b* . . . 1n. The signal station 20 is connected to the plurality of detectors 1*a*, 1*b* . . . 1*n* by signal lines. 21 is a receiving circuit for sequentially receiving, at predetermined time intervals, the detection data while identifying them, and 22 is an A/D converting circuit for converting the analog value of the detection data received by the receiving circuit 21 into a digital value. The detection data after the A/D conversion are input to a storing circuit 23 and stored there at addresses assigned to the respective detectors 1*a*, 1*b* . . . 1*n*, respectively. 24 is an average value computing circuit which sequentially takes out the detection data for the respective detectors stored in the storing circuit 23 by groups of three and makes computation to obtain an average value of the taken-out three data values for preventing an error alarm from being generated by an abnormal data value produced by a noise. 25 is a difference value computing circuit for computing an amount of change for every predetermined period, taking the difference of the respective average values as a difference value. The difference value representing the change amount for every predetermined period is output to a difference value determining circuit 26. In the difference value determining circuit 26, a second threshold level $\alpha$ and a first threshold level $\beta$ which is lower than the first threshold level $\alpha$ are preliminarily set and they are compared with the difference value computed by the difference value computing circuit 25.

As a result of the comparison by the difference value determining circuit 26, if the difference value is below the first threshold value $\beta$, determination of nonfire is made and the detection data is erased to reduce the burden of the computing processing operation in the signal station 20. If the difference value is above the second threshold level $\alpha$, an alarming circuit 29 comprising a buzzer and an alarm lamp is driven to immediately make a fire alarm indication. When the difference value is above the first threshold level $\beta$, but below the second threshold level, the relevant detection data stored in the storing circuit 23 is taken out and output to an approximation equation computing circuit 27 to effect conversion into an approximation equation. 28 is a degree-of-danger determining circuit which computes the degree of danger R based on the converted approximation equation and compares it with a preset threshold level Rs. When the degree of danger R is smaller than the threshold level Rs, i.e. the degree of danger is higher than the preset degree of danger represented by the threshold value Rs, the alarming circuit 29 is driven to generate a fire alarm.

Figure 6:
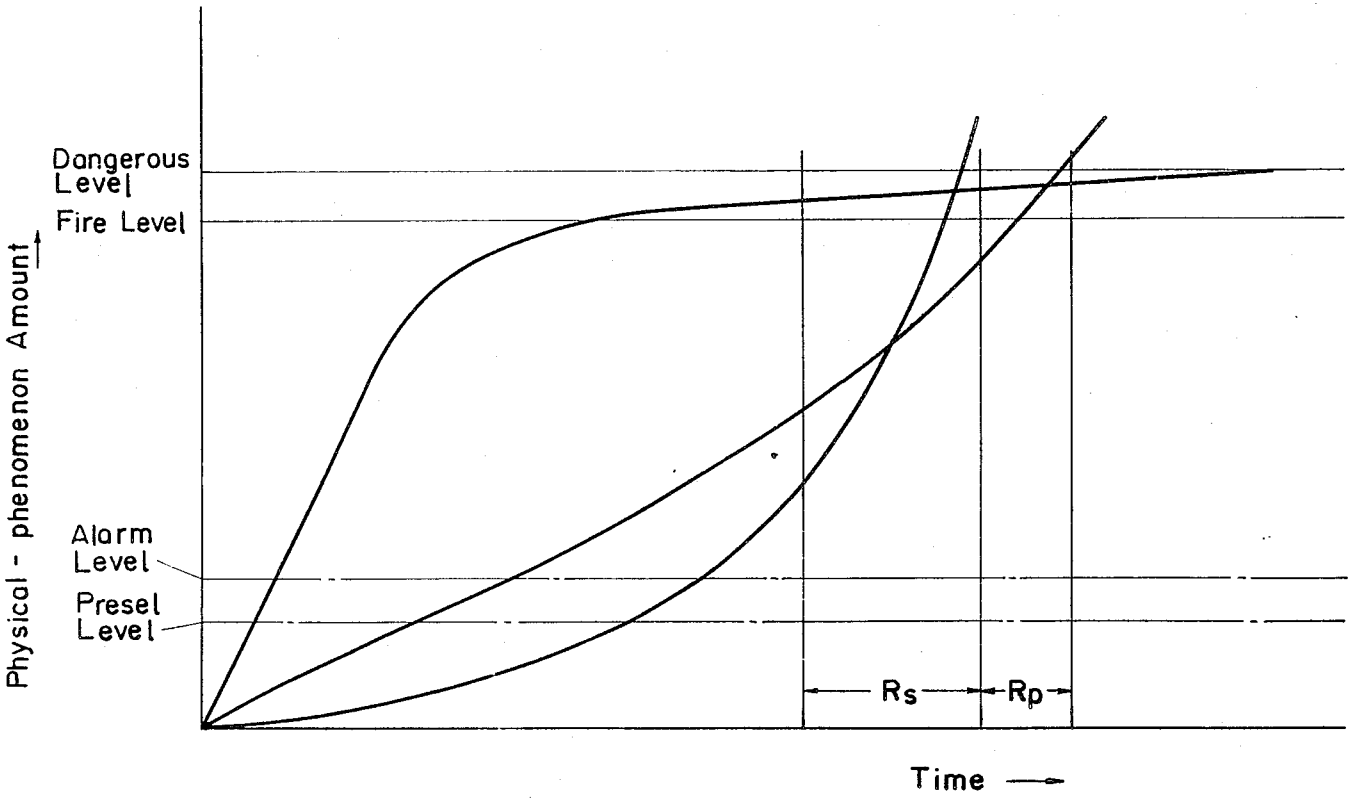
FIG. 6 is a diagram showing determination criterion for information.

In the foregoing, the first threshold level $\beta$ and the second threshold value $\alpha$ represent a difference value which is expected to reach an alarm level and a fire level of FIG. 6, respectively within a predetermined time period. The degree of danger R is a time required to reach the dangerous level and the threshold level Rs is a time necessary to escape from the fire spot.

In accordance with the second embodiment, a difference value is computed based on the detection data sampled for predetermined period and a fire alarm is given upon comparison with the second threshold value preliminarily set so that a fire which shows linear and abrupt change in physical phenomenon can be detected in its early stage.

Further according to the present embodiment, the detection data whose difference value is below the first threshold level is cancelled and the detection data whose difference value is above the first threshold level but below the second threshold level is converted into the approximation equation based on the detection data from the detecting means to obtain the degree of danger from the approximation equation and give an alarm in relation with the threshold level preliminarily set. Thus, the burden of the computing processing operation by the signal station is reduced and necessary detection data can be processed more rapidly and the reliability of the fire alarm system can be increased through accurate fire determination.

Still further according to the present embodiment, when the detection data exceeds the second threshold level, i.e., the fire level, a fire alarm is immediately generated irrespective of the succeeding estimation and computation. Therefore, even when the degree of danger is not high enough to generate an alarm, it can be possible to inform a dangerous condition. Thus, the fire alarm system can improve security against a fire.

In the second embodiment, for the computation of the defference value of the respective average values which is computed based on the groups of plural detection data, e.g. three detection data, of the predetermined period, detection data may be partly overlapped with detection data of the succeeding or preceding group so as to be subjected to the computation for the fire determination. This is so called computation for running average. Thus, the computation of the difference values can be made from a reduced number of detection data and a fire determination can be made more rapidly.

In addition to the alarm level, another preset level may be provided so as to preliminarily initiate computation when the detection data is below the alarm level but exceeds this preset level. In this case, immediately the detection data exceeds the preset level, the computation of the approximation equation is started to eliminate a delay in processing time.

Although the threshold level Rs, i.e. a time required for escape may be selected suitably, considering various conditions of the place where the fire detector is installed, a time $R_p$ necessary for preparation for escape may be further set in addition to the threshold level Rs. With this arrangement, when the degree of danger R is determined to be within the preparation time $R_p$ after the preestimation and computation thereof, an attentioning signal may be generated.

Figure 7:
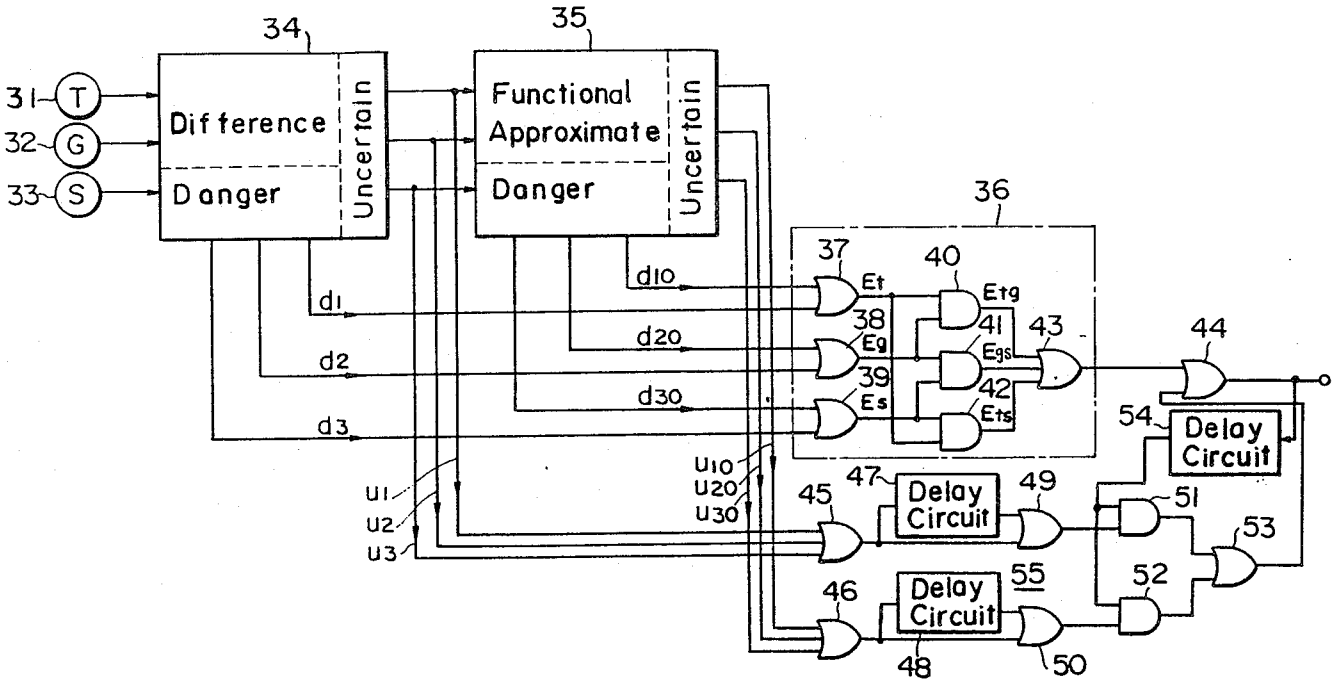
FIG. 7 is a circuit block diagram of third embodiment of the present invention.

There will now be described a third embodiment of the present invention as shown in FIG. 7.

The third embodiment is so formed that detection data of a plurality of physical phenomena which are caused to change by occurrence of a fire are preestimated, computed and determined. As a result thereof, only when the degrees of dangers with respect to two or more physical phenomena are larger than the threshold levels, is determination of fire made. In this embodiment, a time required to reach a dangerous level is computed from the detection data and when the computed time is within a set time necessary for escape, a danger signal is transmitted and when the computed time is below the set time, an uncertainty signal is transmitted. Logical determination is made based upon the danger signal and uncertainty signal, in such a manner that when the danger signal is obtained, a fire signal is output and when the uncertainty signal is obtained after the danger signal has been gotten already, a fire signal is transmitted, and even when the danger signal disappears, a fire signal is continued to be output for some time period.

Figure 8:
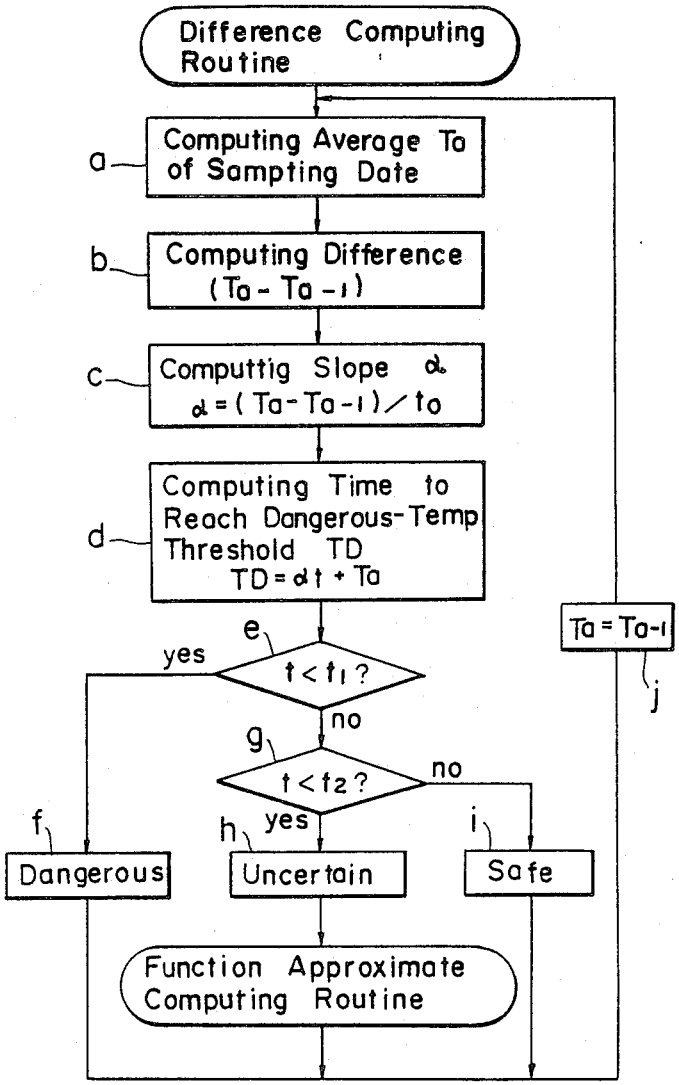
FIG. 8 is a program flowchart of the difference value computing processing operation of the third embodiment.

FIG. 7 is a circuit block diagram of the fire alarm system according to the third embodiment of the present invention and FIG. 8 is a program flowchart showing the operation of the third embodiment.

The third embodiment will now be described in detail referring to FIGS. 7 and 8. 31 is a temperature sensor for detecting, in an analog form, an ambient temperature which is caused to rise by a fire, 32 is a gas sensor for detecting a density of CO gas generated by a fire, and 33 is a smoke sensor for detecting a density of smoke which is caused by a fire. A temperature detection signal T, a gas density signal G and a smoke density signal S are output in the form of analog detection signals from the temperature sensor 31, the gas sensor 32 and the smoke sensor S, respectively.

34 is a difference value computing and determining section which samples, at predetermined time intervals, the analog detection signals from the temperature sensor 31, gas sensor 32 and smoke sensor 33, respectively carries out the computation of difference values each time several number of, for example m, sampled data are obtained so as to calculate a time required to reach a threshold level which is dangerous to the people and makes determination of danger, uncertainty or safety.

The determination of a fire by the preestimation and computation based on the detection data, which is carried out at the difference value computing and determining section 34, is made according the computation routine shown by in flowchart of FIG. 8 wherein the temperature data T is exemplarily shown.

First, at block a, an average value Ta is computed upon every sampling of m temperature data according the following formula:

$$Ta = 1/m \sum_{n=1}^{n} Tn$$

After the computation at the block a, a difference value (Ta−(Ta−1)) is calculated at block b based on the average value Ta−1 previously obtained in the preceding cycle. Thereafter, at block c, a slope $\alpha$ of the temperature change is calculated by dividing the difference value (Ta−(Ta−1)) by a sampling time to (a fixed value). Then, at block d, a time t which is required to reach a predetermined threshold level $T_D$ for a dangerous temperature which is determined as a fire according to the following formulae:

$$T_D = \alpha t + Ta$$

$$t = (T_D - Ta)/\alpha$$

Succeedingly, at determinating block e, a first threshold level, i.e., time t1 and the time t computed at the block d are compared with each other and when the time t is below the first threshold level, time t1, the determination is made to be a fire and a danger signal is output at block f.

In this connection, it is to be noted that the first threshold level, time t1, is a time for determining danger or uncertainty and it corresponds to the time Rs for escape or the preparation time $R_p$ in the foregoing embodiments. The time t corresponds to the time R required to reach the dangerous level in the second embodiment. However, the threshold level $T_D$ of dangerous temperature may differ from a dangerous level and it may be a fire level. In the latter case, the first threshold time t1 may be changed.

On the other hand, if the time t is larger than the first threshold time t1 at the determining block e, the time t required to reach the dangerous temperature $T_D$ is compared with a second threshold time t2 to determine at the block g as to whether the time t is safe and free from a fire or uncertain or doubtful. When the time t is below the second threshold time t2, an uncertainty signal is output at block h. When the uncertainty signal is output at block i, the operation proceeds to a function approximation computation routine. When the time t1 is above the second threshold time t3 at the determining block g, the temperature rise is determined to be due to other cause than a fire and determined to be safe at the block i.

After completion of the series of determination operation based on the difference values, the previous average value Ta-1 is substituted for the average value Ta now obtained at the block j and the operation is returned to the block a.

Referring again to FIG. 7, a function approximation computing and determining section 35 is provided after the difference value computing and determining section 34 so that the function approximation computing and determining section 35 may carry out the computation and determination of fire based on the detector data from the respective detector sensor in such a manner as in the first embodiment only when the difference value computing and determining section 34 outputs an uncertainty signal.

A danger signal output after the operation by the difference value computing and determining section 34 and the function approximation computing and determining section 35 is input to a logical determining circuit 36. The logical determining circuit 36 carries out logical determination in such a manner that when danger signals based on at least two different detection data are generated, a fire signal is output.

More specifically, letting a danger signal based on the temperature data, a danger signal based on the gas density and danger signal based on the smoke density output from the difference value computing and determining section 34 be d1, d2 and k3, respectively, and letting a danger signal based on the temperature, a danger signal based on the gas density and a danger signal based on the smoke density which are output from the function approximation computing and determining section 35 be d10, d20 and d30, respectively, logical sums of the danger signals d1 and d10 based on the same detection data, of the danger signals d2 and d20 based on the same detection data and of the danger signals d3 and d30 based on the same detection data are taken out through OR gates 37, 38 and 39, respectively. As a result, a temperature danger singnal Et is output from the OR gate 37, a gas danger signal Eg is output from the OR gate 38 and a smoke danger singal Es is output from the OR gate 39. The outputs from the OR gates 37 to 39 are input to AND gates 40, 41 and 42. The AND gate 40 outputs a H-level signal i.e. signal Etg when the temperature danger signal Et and the gas danger signal Eg are obtained. The AND gate 41 outputs a H-level signal i.e. signal Egs when the gas danger signal Eg and the smoke danger signal Es are obtained. The AND gate 42 generates a H-level signal i.e. signal Ets when the smoke danger signal Es and the temperature danger signal Et are obtained.

The outputs from the AND gates 40 and 42 are all input to an OR gate 43 to be output as a H-level signal of the OR gate 43 so as to generate a fire signal through an OR gate 44.

In addition to the logical determining circuit 36, which determines a fire and outputs a fire signal based on at least two danger signals, a logical determining section 55 is provided to continue output of a fire signal when an uncertainty signal is obtained after the fire signal has been output based on the danger signals or when neither of danger signal and uncertainty signal are obtained temporarily.

The logical determining section 55 comprises an OR gate 45 to which uncertainty signals u1, u2 and u3 corresponding to the respective detection data from the difference value computing and determining section 34 are input and an OR gate 46 to which uncertainty signals u10, u20 and u30 from the function approximate computing and determining section 35 are input. Outputs from the OR gates 45 and 46 are supplied directly to one of the inputs of OR gates 49 and 50, respectively and further supplied to another input through delay circuits 47 and 48, respectively. Outputs from the OR gates 49 and 50 are connected to one of inputs of AND gates 51 and 52, respectively. Other inputs of the respective AND gates 51 and 52 are so connected as to receive an output of the OR gate 44 through a delay circuit 54. Outputs from the AND gates 51 and 52 are input to OR gate 53 and an output from the OR gate 53 is supplied to one of the inputs of the OR gate 44 whose other input is so connected as to receive the output from the logical determining circuit 36.

The delay circuits 47, 48 and 54 each have a function to delay the signals input thereto by one cycle of computation by the difference value computating and determining section 34 and the function computing and determining section 35.

In this connection it is to be noted that the logical datermining circuit 36 may also output a fire signal in response to a combination of two or more different kinds of danger signals from the difference value computing and determining section 34 and the function approximation computing and determining section 35.

The operation of the logical determining section 55 in the embodiment of FIG. 7 will now be described.

Figure 9:
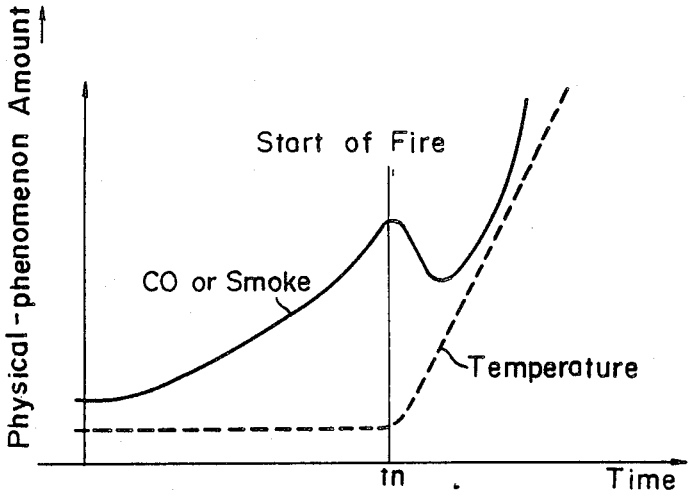
FIG. 9 is a time chart showing changes in temperature and densities of smoke and CO gas.

In the diagram of FIG. 9, now assuming that the density of smoke or CO gas is increased with time due to smoldering and the smoldering is developed into a fire at a time tn, the density of smoke or CO gas is transiently reduced due to generation of hot air stream or complete combustion caused by the starting of fire. On the other hand, the temperature is kept substantially constant at the stage of smoldering before starting of fire as shown by a broken line, but it quickly rised after starting of fire at the time tn.

Figure 10:
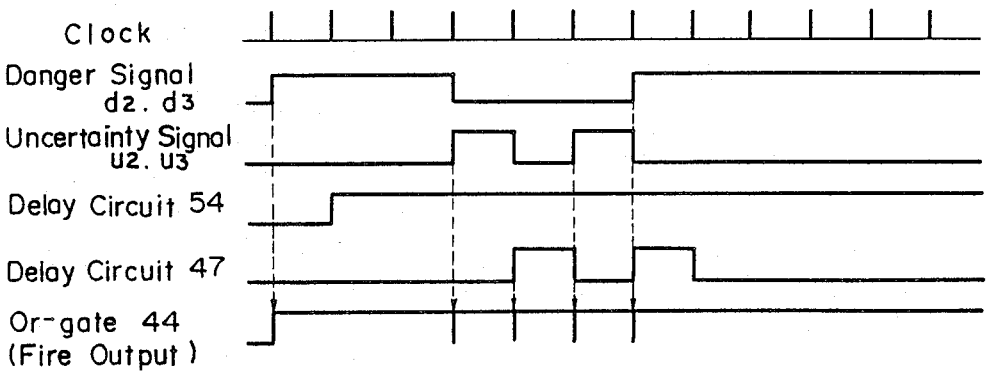
FIG. 10 is a time chart showing an operating waveform of a logical determination section.

With respect to the change in the densities of smoke and CO gas and the temperature as shown in FIG. 9, if danger singales d2 and d3 are output as a result of the computation and preestimation by difference value or function approximation based on the increase in the smoke density as shown for example by the time chart of FIG. 10, the logical determining circuit 36 outputs a fire singnal through the OR gate 44 by the two danger signals d2 and d3. Such danger signals d2 and d3 are transmitted every cycle of computation and preestimation which corresponds to a clock.

Thereafter, the densities of smoke and C gas are lowered due to starting of fire at time tn and uncertainty signals u2 and u3 are began to be transmitted instead. In response to the uncertainty signals u2 and u3, the OR gate 45 of the logical determing section 55 generates a H-level output which is supplied to one input of the AND gate 51. At this time, a delayed output based on the danger signal of the previous period is being supplied to the AND gate 51 from the delay circuit 54, and the AND gate 51 is in its enable state. Therefore, a fire signal based on the uncertainty signals u2 and u3 are transmitted through the AND gate 51, OR gate 53 and the OR gate 44.

Subsequently, if the difference value computing and determining section 34 determines safety based on the lowering of the smoke and CO gas densities and no danger signal and uncertainty signal are generated, since the output of the OR gate 45 based on the previous uncertainty signal is being supplied to the OR gate 49 after being delayed by one cycle by the delay circuit 47 and at this time a delayed output is generated from the delay circuit 54 by the output of the previous fire signal based on the uncertainty signal, the AND gate 51 is in its enable condition and a H-level output based on the uncertainty signal delayed by the delay circuit 47 is transmitted as a fire signal through the OR gate 49, AND gate 51, OR gate 53 and OR gate 44.

Then, a certain length of time has been passed from the starting of fire, the densities of smoke and CO gas begin to increase again. Therefore, uncertainty signals u2 and u3 are transmitted again and they are switched to the danger signals d2 and d3, so that a fire signal is continued to be output from the OR gate 44 irrespective of the transient condition which is determined to be safe.

Although the logical determination is carried out based on the danger signal obtained by the combination of the difference value method and the function approximation method in the third embodiment, determination of fire may be made in such a manner that a fire is determined when at least two danger signals are obtained from different kinds of detection data obtained by the fire determination according to the difference value mithod or function approximation method.

Various techniques disclosed in relation with the respective embodiments may be applied to any other embodiment as discribed above although the description thereof is omitted in the specification.

As described above, according to the present invention, a time required to reach the level which is dangerous to the people is computed and preestimated based on the data of a change in the physical phenomena of the surroundings and the time is compared with a time necessary for escape so as to give a fire alarm related to the escape time. Thus, suitable guidance for escape can be conducted.

FIGS. 11 to 17 show a fourth embodiment of the present invention. This fourth embodiment differ from the first, second and third embodiment as using a linear regression line to computing and to preestimating a fire.

In the drawings, 101 is a detecting section which detects a change in the physical phenomena of surroundings related to the occurrence of a fire and output analog data corresponding to the change. A plurality of detecting sections may be provided. 102 is a data sampling section which comprises a filter etc. for eliminating noises from the data output from the detecting section or sections 101 and which makes data sampling at every predetermined period. 103 is a storing section for storing the sampled data output from the data sampling section 102. In case a plurality of detecting sections 101 are provided, the data from the respective detecting sections 101 are allotted with addresses and stored by the addresses.

104 is a regression line computing section which computes a future tendency expected from the data stored sequentially in the storing section. The computing of the regression line is made by using a conventional statistical method, a linear function approximation. 105 is a danger degree computing section which computes a time which is estimated to be needed for the future value expected from the regression line to exceeds the predetermined value, based on the predetermined number of the latest data stored in the storing section 103. The latest data required for this computation are extracted and supplied by a data extracting section 106 from the storing section 103. The obtained estimated time is compared by a danger time comparing section 107 with a time Rs required for escape from a fired area, a time Rp necessary for preparation for escape a time Rt for setting extinguishing device or other action to be taken. At this time, if the estimated time is shorter than the required time, the danger time comparing section 107 outputs a signal. In response to the signal, an alarm A is given.

Figure 11:
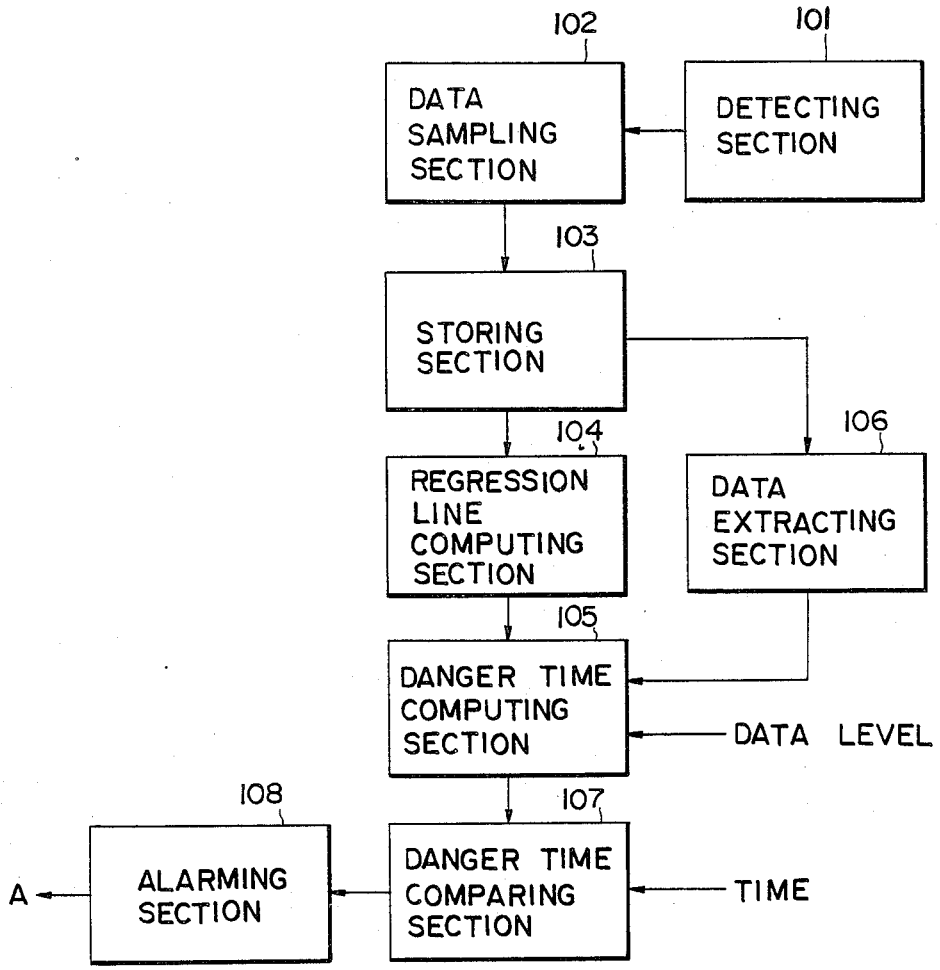
FIG. 11 is a block diagram of a fourth embodiment of the present invention.
Figure 12:
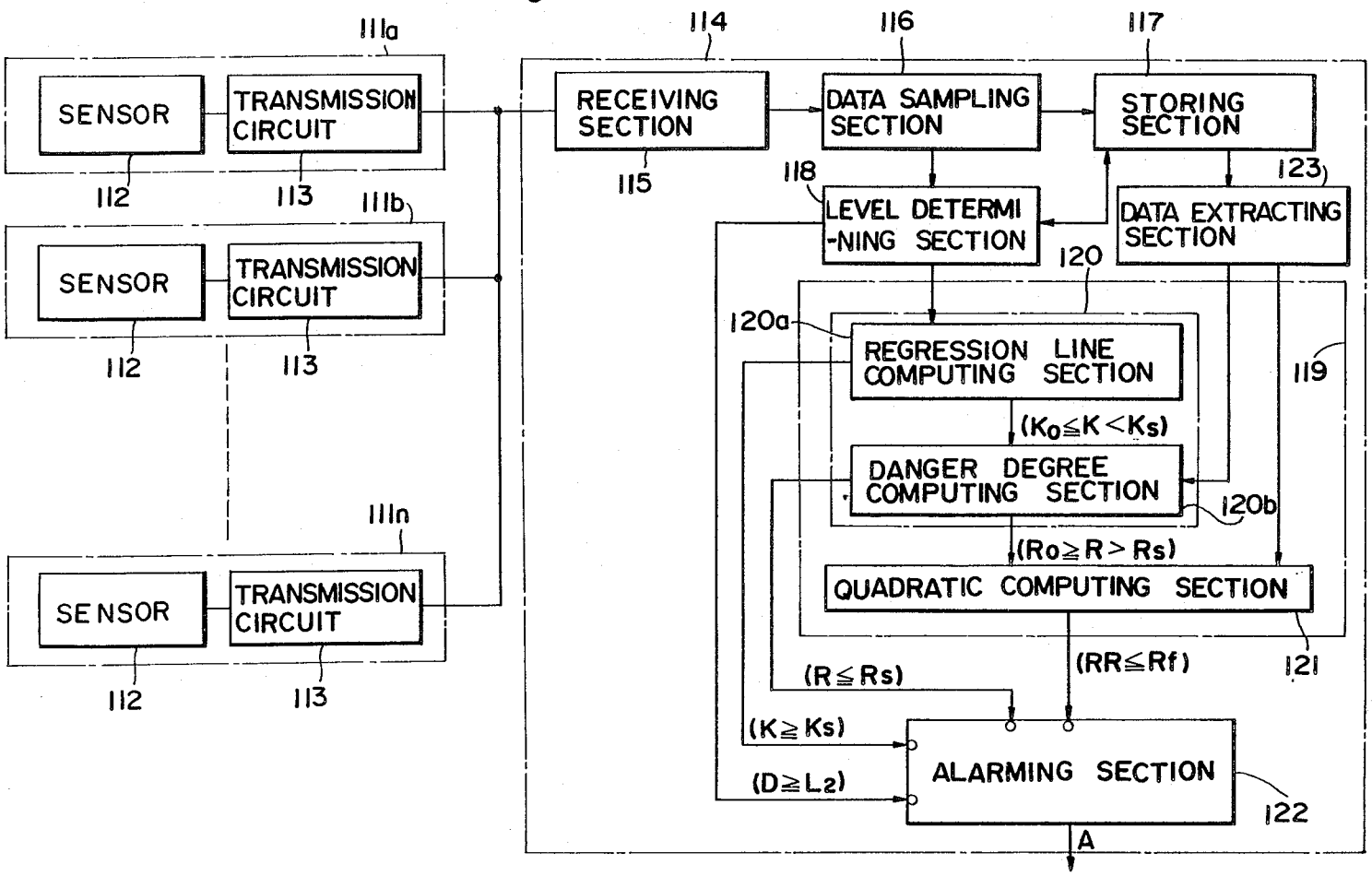
FIG. 12 is a block diagram of a concrete example of the fourth embodiment.
Figure 13:
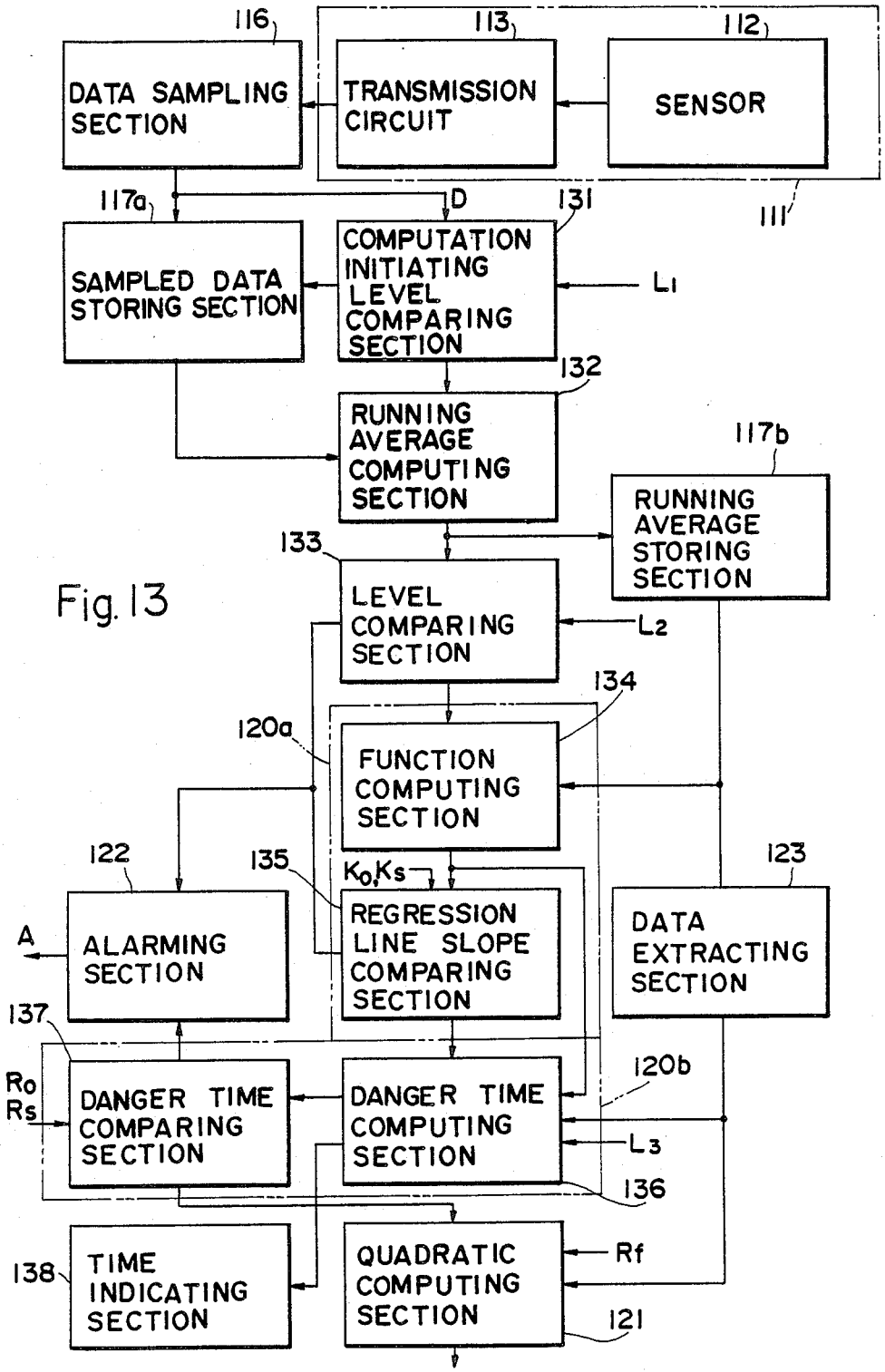
FIG. 13 is a block diagram showing further details of the example illustrated in FIG. 12.

FIGS. 12 and 13 illustrate a concrete arrangement of the system of the embodiment illustrated in FIG. 11.

In the arrangement, 111*a*, 111*b* . . . 111*n* are analog type detectors for detecting the smoke caused due to a fire in the form of an analog amount. The analog type detectors 111*a*, 111*b*, . . . 111*n* are preliminarily allotted with addresses, respectively. Each of the analog type detectors 111*a*, 111*b*, . . . 111*n* includes a sensor 112 for detecting a smoke density and a transmission circuit 113 for transmitting the detection data detected by the sensor 112. 114 is a central signal station which includes a microcomputer for processing the detection data from the plurality of analog type detectors 111*a*, 111*b* . . . 111*n* so as to predictively determine a fire based on the producing computation.

In the central signal station 114, 115 is a receiving section including an A/D converting circuit which gathers the detection data from the respective analog type detectors 111*a*, 111*b*, . . . 111*n* by a polling method every predetermined time t sec and makes A/D conversion of the data for outputting the same to a data sampling section 116. The data sampling section 116 processes the A/D converted detection data from the receiving section 115 separately by the analog type detectors 111*a*, 111*b*, . . . 111*n* to generate an output to a storing section 117 and a level determining section 118. In the level determining section 118, threshold values of a fire level L2 and a computation initiating level L1 lower than the fire level L2 are set so as to make the first determination when an abrupt change is caused in smoke density and the determination for the predictive computation initiation.

A computing section 119 comprises a primary computing section 120 for carrying out a primary computation and a secondary computing section 121 for carrying out a secondary computation so as to effect an predicting computation by the primary and secondary computations. The primary computing section 120 includes a regression line computing section 120*a* and a danger degree computing sction 120*b* for computing a regression line by a least squares method and determining a slope of the regression line or making predicting computation based on the danger degree determination. The secondary computing section 121 is actuated by a signal from the primary computing section 120 to take out the data stored in the storing section 117 and convert the data into quadratic or higher-degree functional equations by the function approximation so that a time needed from the present time to reach the danger level L3 is computed based on the approximation equation. The aforementioned approximation equation computing circuit of the first, second and third embodiment is employed for thus secondary computing section 121.

An alarming section 122 includes an alarm indicating means such as a buzzer, a lamp, etc. and it is adapted to be actuated by a fire signal from any of the level determining section 18, the regression line computing section 120*a*, the danger degree computing section 120*b*, and the secondary computing section 121 to drive the alarm indicating means for giving an alarm.

In the drawings, 123 is a data extracting section which extracts and supplies the data of the storing section 117 to the primary computing section 20 and the secondary computing section 121 according to necessity.

The level determining section 118 comprises, as illustrated in FIG. 13, a computation initiating level comparing section 131, a running average computing section 132,. and a level comparing section 133. The computation initiating level comparing section 131 generates an output when the value D of the data output from the data sampling section 116 exceeds the computing initiating level L1 ($D \geqq L1$), and actuates the running average computing section 132. The running average computing section 132 extracts a plurality of sampled data (for example 3 data) from the sampling data storing section 117*a*, sequentially computes the running averages LD thereof and outputs the same to the level comparing section 33. The level comparing section 133 compares the running averages LD with the fire level L2. More particularly, when the running average LD is equal to or higher than the fire level L2, the level comparing section 133 determines that it is due to an abrupt increase in smoke density caused by a fire and outputs a fire signal to the alarming section 112. When the value LD of the data is equal to or higher than the level L1 but lower than the level L2, initiation of the predicting determination is instructed to the computing section 119 by designating the address of the analog type detector 111*a*, 111*b*, . . . 111*n* which has output the detection data exceeding the threshold value L1. Further, when the value LD of the data is lower than the level L1, the section determines that it is a normal condition and inhibits the predicting computation by stopping the signal output to the computing section 119.

The running average computing section 132 or the computing section 119 may be so adapted as to be actuated when a plurality of the sampled data D1, D2 . . . Dn continuously exceed the computation initiating level L1 or a plurality of the running averages LD1, LD2 . . . LDn are continuously equal to or higher than the level L1 but lower than the level L2. In this case, erroneous operation due to noises can be minimized. Alternatively, all the computing sections 119 may be operated, but this is not advantageous in efficiency. The computed running averages LD are also supplied to a running average storing section 117*b* which constitutes the data storing section 117.

Figure 14:
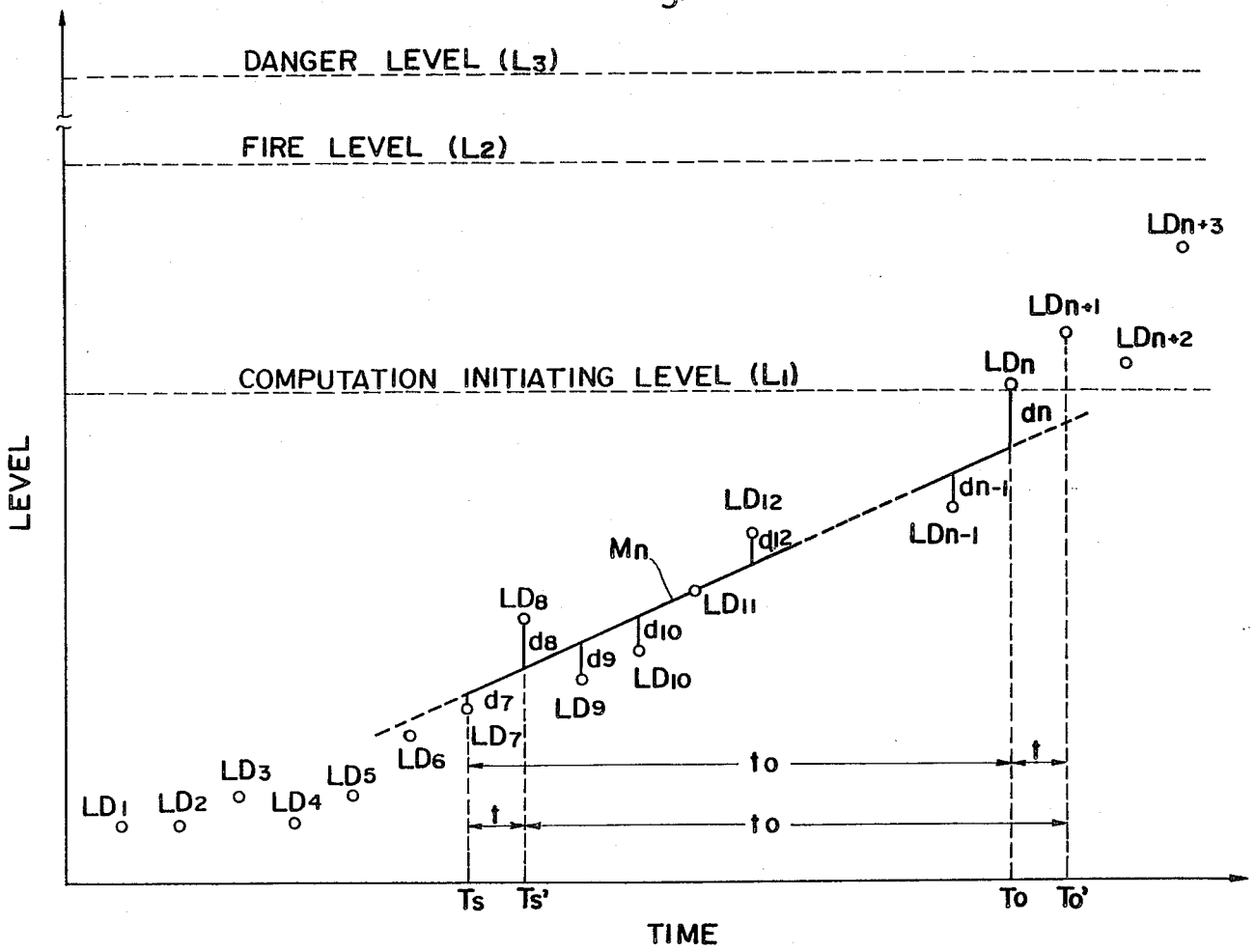
FIGS. 14 and 15 are graphs each showing the relationship between the data and the regression line.
Figure 15:
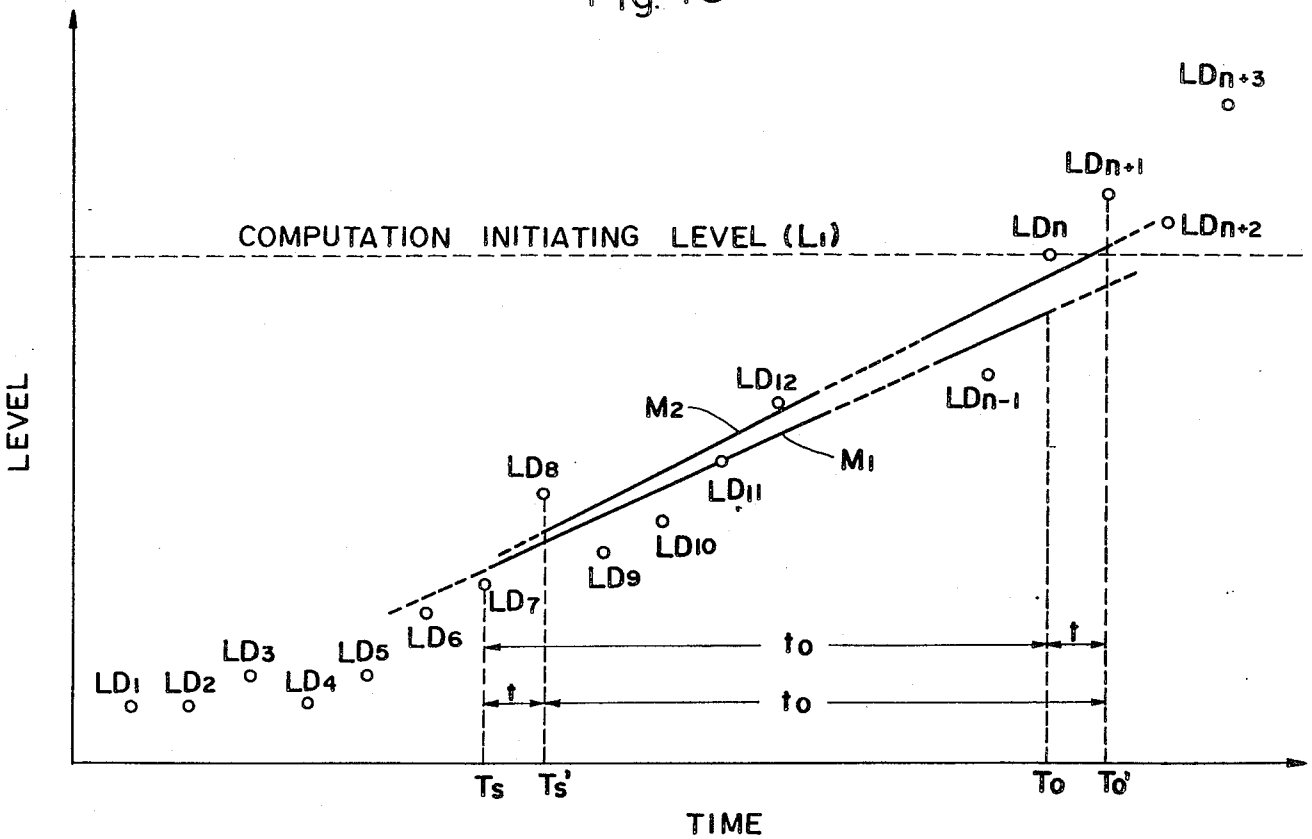

The regression line computing section 120*a* comprises a function computing section 34 and a slope comparing section 135. The function computing section 134 receives the running averaves LD1, LD2 . . . LDn from the running average storing section 17*b* by a signal from the level comparing section 133 and computes the regression line formed by these running averages Dm. More particularly, when the running average data LD is determined to be equal to or higher than the level L1 but not equal to or higher than the level L2 in the level determining section 118, an extracting point Ts which is back by a predetermined time to from the present time To as shown in FIG. 14 is set and the data LD7, LD8, LD9, LD10, LD11, LD12, . . . LDn (extraction data) during the extracting time to from the extracting point Ts to the present time To are extracted. The extracting time to is set for example to be 90 seconds. The regression line M1 is computed by the least squares method based on the extraction data LD7, LD8, LD9, LD10, LD11 . . . LDn during the extracting time to. If the condition $L1 \leqq LD < L2$ lasts, regression lines M1, M2 . . . are computed by the least squares method based on the extraction data during the extracting time to back from the present time To whenever the following data LDn+1, LDn+2, LDn+3 . . . are obtained as shown in FIG. 15. At the slope comparing section 135, the coefficients K of the regression lines M1, M2 are computed and a fire predicting determination is made based on the values of the coefficients K. In the slope comparing section 135, a threshold value Ko representative of a normal value and a threshold Ks which is higher than the threshold value Ko are preliminarily set and when the computed coefficient K is equal to or higher than the threshold Ks, it is determined as a fire and a fire signal is output to the alarming section 112. When $Ko > K < Ks$, the danger degree computing section 110*b* is actuated.

The computation of the regression line M is performed to compute coeffcients a, b of the line y =ax +b by minimizing $$\sum_{m=1}^{n} d^2m$$

where the differences between the respective running average data LD7, LD8, . . . LDn and the phantom line y =az +b ay aextrat time of these LD7, LD8, . . . LDn as shown in FIG. 14 are assumed as d7, d8, . . . dn.

Figure 16:
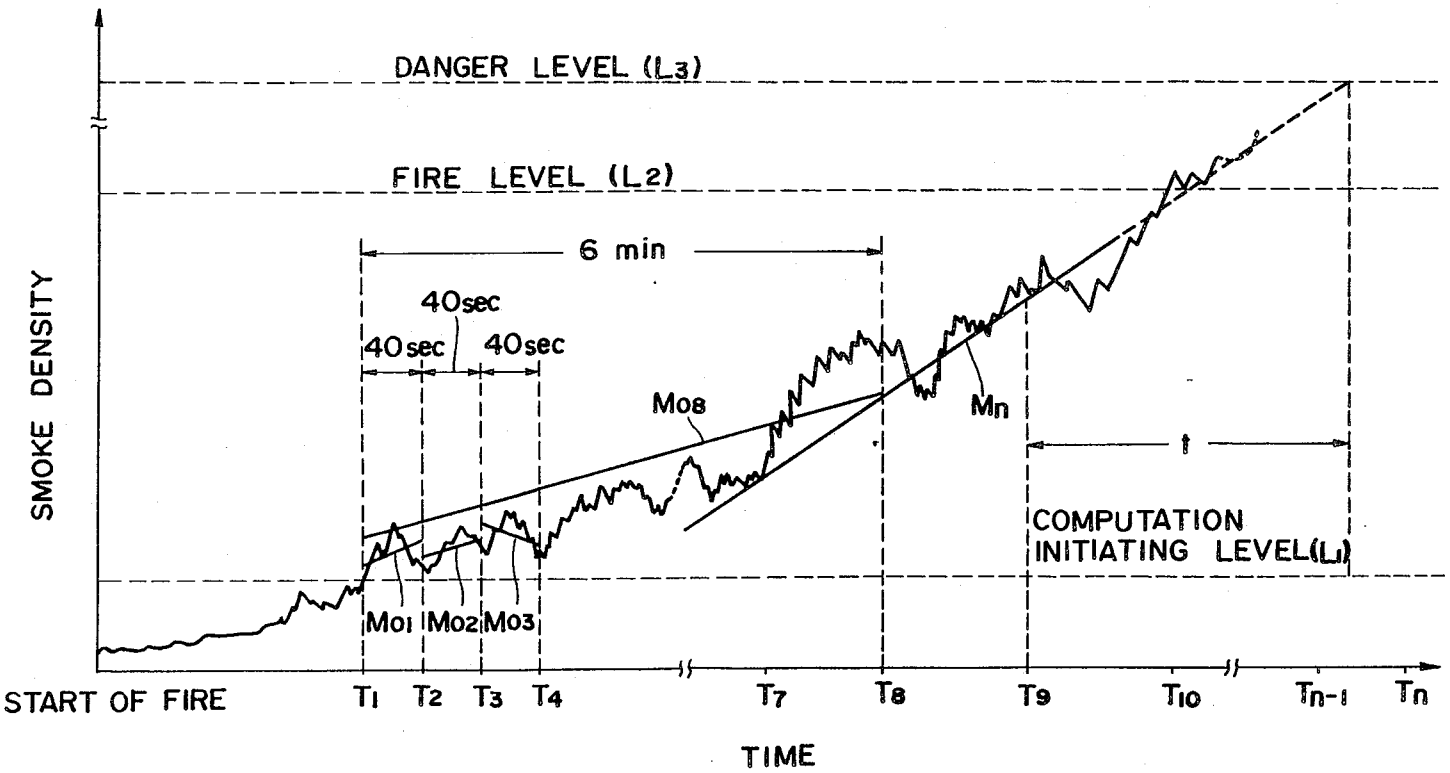
FIG. 16 is a graph showing the change of a smoke density as fire data with time in relation with a fire determination.

The danger degree computing section 120*b* comprises a danger time computing section 136 and a danger time comparing section 137. In the danger time computing section 136, a danger level L3 which is higher than the fire level L2 is set as shown in FIG. 16, and a time t (hereinafter referred to as a danger degree R) which is to be taken from now to reach the danger level L3 is computed based on the regression line. In the danger time comparing section 137, a threshold value Ro representing a normal value and a threshold value Rs which is smaller than the threshold value Ro (which is more dangerous than the threshold value Ro) are preliminarily set for effecting a predicting determination of a fire based on the danger degree R. When the computed danger degree R is equal to or smaller than the threshold value Rs, it is determined as a fire and a fire signal is output to the alarming section 122. When Ro≧R>Rs, it is determined as being uncertain and a signal is output to the secondary computing section 121. In the drawings, 138 is a time indicating section which can directly indicate the time t (that is thea danger degree R).

In this connection, the back time to is considered referring to FIG. 16. According to the expeiments conducted by the inventors, if regression lines Mo1, Mo2, Mo3 are obtained based on the extraction data obtained at points back by a shorter period, for example 40 seconds, from the present time T2, T3, T4, respectively, the slopes of the regression lines are sometimes positive and at another time negative. This is because the regression lines are obtained based on the data which contains not only a basic wave component of smoke but also noise components such as flickering frequency components of flame. As a result, the fire determination is made or not, depending upon the noise conditions.

On the other hand, if the regression line based on the extraction data at a point back by 40 seconds which contains noises due to smoke from cigarettes etc. has a slope whose coefficient exceeds the threshold value, a fire determination is made and an alarm is erroneously given. Thus, when the extraction time is as short as 40 seconds, the influence by the intervening noises may be large and there is a possibility of misoperation.

However, if the extraction time is set longer and, as illustrated in FIG. 16, if a regression line Mo8 is obtained based on the extraction data at a point back by, for example, 6 minutes from the present time T8, the slope of the regression line MO8 is smoothed by the long extraction time. More specifically, even if a fire spreads very rapidly as in the case of oil fire, the fire is processed by the data which includes data at a normal time as well as a fire data. Thus, the abruptly increasing data is smoothed by the data at the normal time and the slope is made gentle. As a result, the future value of the data will not exceed the threshold value for a long time and a fire determination will not be made until then. In this case, there is a fear that an alarm is failed to be given even though the smoke density increases abruptly. It can thus be concluded that, according to the inventors' experiments, the time to to be back is preferably 60 seconds or more but 5 minutes or less. However, the time to should be determined considering various conditions such as the place where the system of the present invention is installed, materials feared to be fired.

The secondary computing section 121 is actuated by an uncertain signal from the primary computing section 120 to take out the running averages lD of the data stored in the running average storing section 117*b* and convert the same into a quadratic or higher-degree functional equation, i.e. an approximation equation by the function approximation for computing a time (danger degree RR) to be needed from now until it reaches the danger level L3. In the secondary computing section 121, a threshold value Rf (Rf≧Rs) is set and when the computed danger degree RR is equal to or smaller than Rf, a fire determination is made and a fire signal is output to the alarming section 122. The alarming section 122 includes an alarming means such as a buzzer, a lamp, etc. as described above and is actuated by a fire signal from any of the level determining section 118, the regression line computing section 120*a*, the danger degree computing section 120*b* and the secondary computing section 121.

Figure 17:
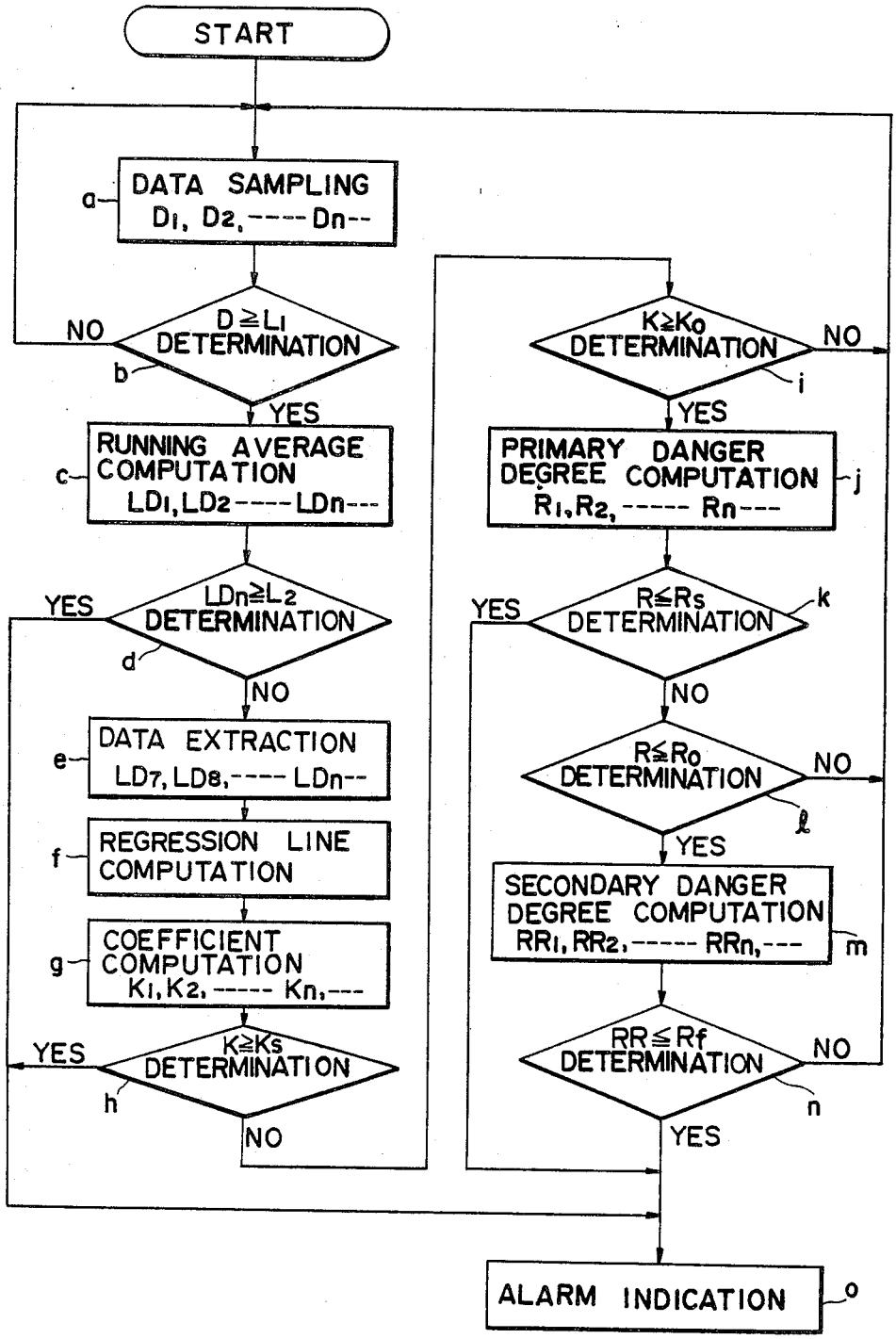
FIG. 17 is a flowchart for the fire determination in the fourth embodiment.

FIG. 17 is a flowchart when a microcomputer is employed and shows the operation of the predicting determination based on the predicting computation. For example, if the analog type detector 111*a* detects smoke due to a fire and transmits the detection data corresponding to the amount of smoke, sampling is made at every predetermined period and data to be processed D1, D2, . . . Dn are obtained at block a. At block b,, these data D1, D2 . . . Dn are compared with the computation initiating level L1 in the computation initiating level comparing section 31 of the level determining section 118 and when it is determined Dn≧L1 at the present time To, the step is advanced to block c. At block c, running averages Ld1, Ld2, . . . LDn are sequentially computed from these data D1, D2, . . . Dn. At block d, the running averages Ld computed by the running average computing section 132 are compared with the threshold value L2 which represents the fire level and when the data LDn is smaller than the threshold value L2, an instruction signal is output to the primary computing section 110 to instruct the initiation of the primary computation. At block e, the data LD7, LD8, . . .LDn during the predetermined time to back from the present time To to the extraction point Ts are extracted from the running average storing section 117*b* and the regression line Mn is computed by the least squares method based on the extracted data LD7, LD8, . . . LDn. At block g, the slope Kn of the regression line Mn is computed. At block h, the slope Kn is compared with the threshold value Ks and when the slope Kn is smaller than the threshold value Ks, the step is advanced to block i for further comprising the slope Kn with the threshold value Ko. When the slope Kn is smaller than the threshold Ko, the step is returned to block a and starts the sampling of the following detection data Dn+1 after the predetermined time t has passed. When the value of the detection data Dn+1 is equal to or larger than the level L1, the step proceeds to block e through the determination of blocks b and d and extracts the data LD8, LD9, . . . LDn+1 during the period from the time To' after the time t has passed to the extracting points Ts' which is back by the predetermined time to. At block f, the regression line Mn+1 is computed based on the extracted data LD8, LD9, . . . LDn+1. At block g, the slope Kn+1 of the regression line Mn+1 is computed and the value of the slope Kn+1 is determined at blocks h an i. When Kn+1<Ko<Ks, the step is again returned to block a to sample the detection data. Similar operations will be repeated so as to extract the data during the predetermined time to back from the present time whenever the detection data withinthe predetermined range is obtained and the slopes Kn+2, Kn+3 . . . of the regression lines Mn+2, Mn+3 if Ko<Kn+3<Ks, the step proceeds to block j after the determination of blocks h and i. At block j, the danger dgree R1, R2 . . . Rn are computed based on the regression lines and at block k, the value of the danger degree Rn is compared with the threshold value Rs. When Rn is determined to be equal to or smaller than Rs, the step proceeds to block o for giving an alarming indication. When Rn>Rs, the step proceeds to block 1 for comparing the value of the danger degree Rn with the threshold value Ro. When Rn≦Ro, an uncertain signal is output to the secondary computing section 21 to instruct the initiation of the secondary computation. At block m, all the data LD1, LD2, LD3 . . . LDn, LDn+1 . . . are extracted from the running average storing section 117*b* so as to be converted into approximation equations by the function approximation method for computing the danger degree RR1, RR2, . . . RRn based on the approximation equations. At block n, the value of the danger degree RRn is subjected to the determination and when RRn≦Rf, a determination of a fire is made and the step is advanced to block o for giving the alarming indication. It will be better to arrange the running average storing sction 117*b* to be able to store same data LD, for example twenty data, and to be able to delete the stored oldest data when the newest data is input from the running average computing section 132.

Although the danger degree computing section 120*b* is operated when the determination of uncertainty (Ko≦K<Ks) is obtained in the predicting determination of the regression line computing section 120*a* in the present embodiment, the regression line computing section 20*a* and the danger degree computing section 120*b* may be operated in parallel based on an instruction from the level determining section 118 so that when a fire determination (K≧Ks or R≦Rs) is obtained from either of the sections, a fire signal is immediately output for giving the alarm indication. In this case, the fire determination is made more rapidly.

In the primary computing section 120 and the secondary computing section 121, the numbers of extracting data from the running average storing section 117*b* are able to differ each other. Namely it will be able to arrange if the storing section 117*b* stored twenty data LD, the primary section 120 extract ten data counted from the newest stored data to compute and while the secondary section 121 extract all twenty stores data also to compute and to make more detailed judgement. Of course, it is able to arrange both sections 120,121 extract the same number of data to compute and to judge.

In the embodiment as illustrated, a plurality of analog type detectors 111*a*, 111*b*, . . . 111*n* which detects smoke caused by a fire as an analog amount, but other type of analog detectors such as a heat sensor which detects temperature rise or increase in CO gas concentration or a gas sensor may alternatively be employed.

Figure 18:
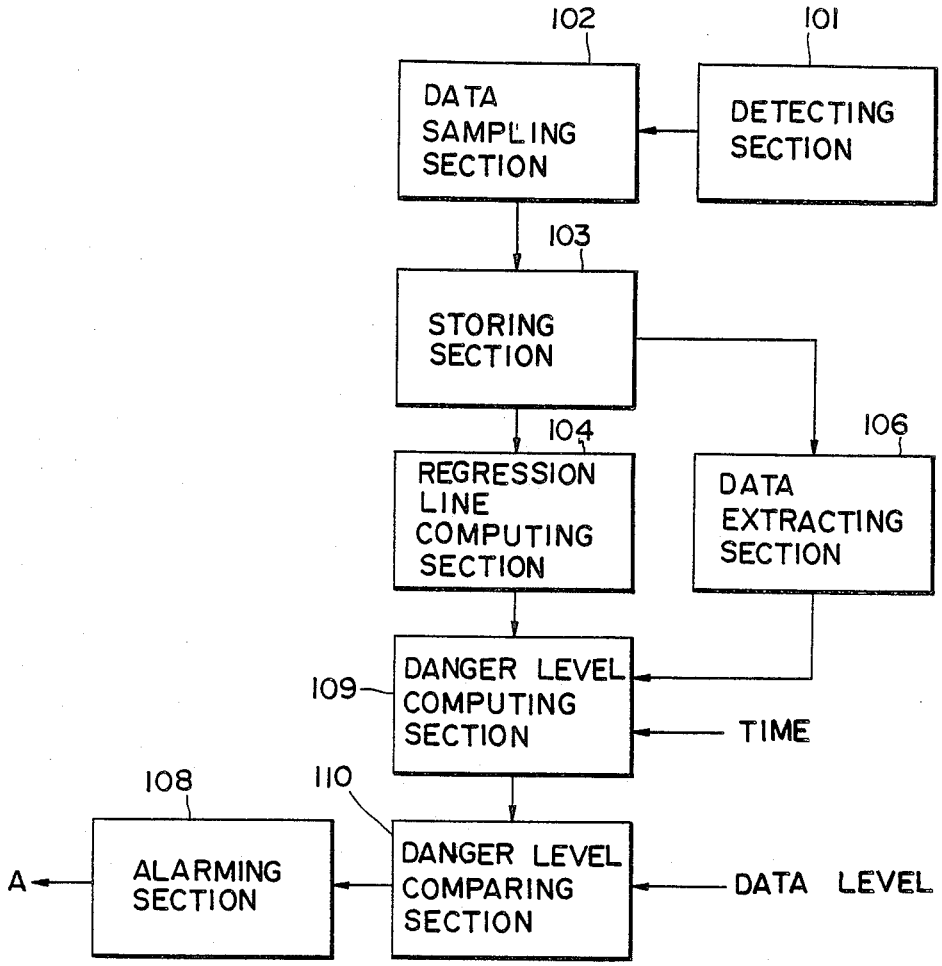
FIG. 18 is a block diagram of a fifth embodiment of the present invention.

FIGS. 18 to 111 illustrate a fifth embodiment of the present invention. This embodiment has, as shown in FIG. 18, an arrangement similar to that of the fourth embodiment in FIG. 1*b* and comprises and a detecting section 101, a data sampling section 102, a storing section 103, a regression line computing section 104. a data extracting section 106 and an alarming section 108 are substantilly the same as those of the first embodiment.

A danger level computing section 109 computes a future value of the physical phenomenon of the surroundings related to the occurrence of a fire after a predetermined time Td has passed which is predicted from the regression line obtained by the regression line computing section 104, based on a predetermined number of the latest data stored in the storing section 103. As in the fourth embodiment, these data are supplied by the data extracting section 106. The resultant predicted value of the data is compared with a predetermined data level at a danger level comparing section 110. When the predicted value exceeds the predetermined data level, the comparing section 110 outputs a signal to an alarming section 8. The alarming section 8 generates an alarm A in response to the signal.

Figure 19:
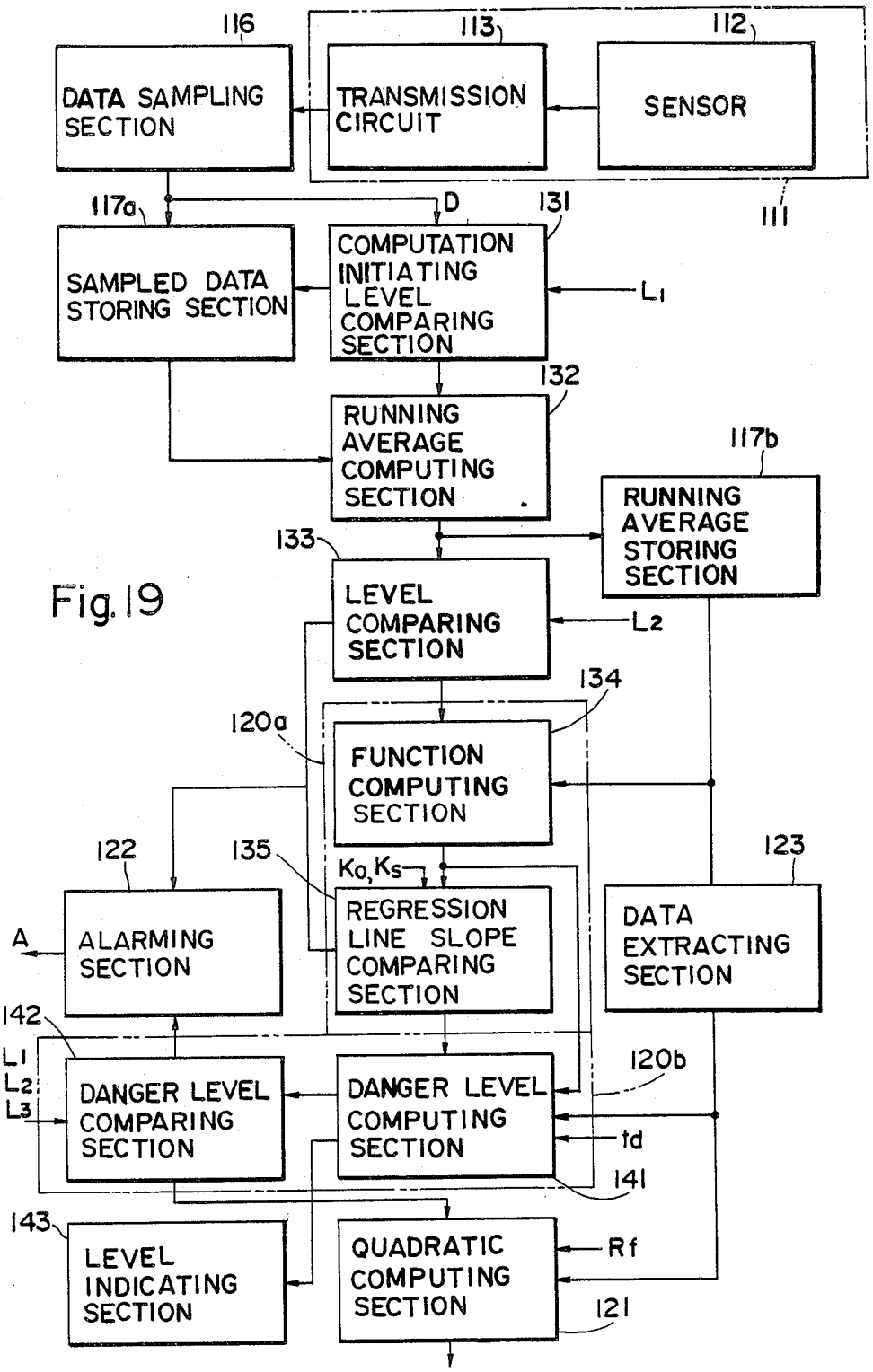
FIG. 19 is a block diagram showing the detail of the embodiment as illustrated in FIG. 18.
Figure 20:
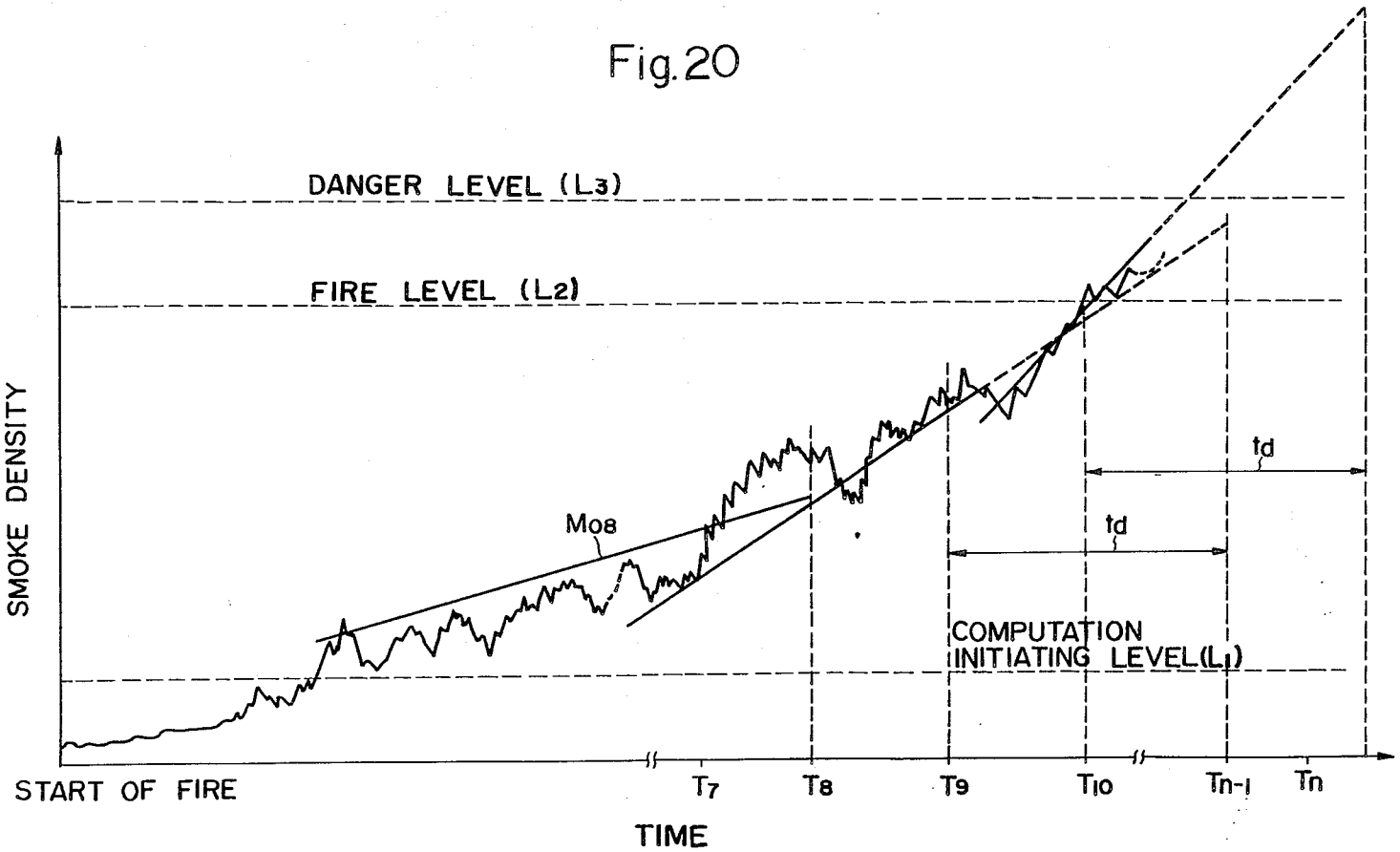
FIG. 20 is a graph showing the change of a smoke density as fire data with time in relation with a fire determination.

The concrete formation of the fifth embodiment is similar to that shown in FIG. 13 of the fourth embodiment except for a dnger degree computing section 120*b* as can be seen from the details shown in FIG. 19. In FIG. 19, the danger degree computing section 120*b* comprises a danger level computing section 141 and a danger level comparing section 142. The danger level computing section 141 computes an expectable data level after a predetermined time td has passed from now based on the data extracted from the running average storing section 117*b* through the data extracting section 123 and the regression line (FIG. 20). On the other hand, the danger level comparing section 142 has preset levels L1, L2 and L3 as described before for performing an predicting determination of a fire based on the predicted data level F and generates an output corresponding to the estimated level at the computing section 141. More particularly, when F≧L2 or F≧L3, a predetermined fire signal or danger signal is output to the alarming section 122. When L1≦F<L2, an uncertain condition is determined and a signal is output to a secondary computing section 121. The secondary computing section 121 operates in a manner similar to that of the first embodiment. 143 is a level indicating section for displaying the level so that it may be visually confirmed.

Figure 21:
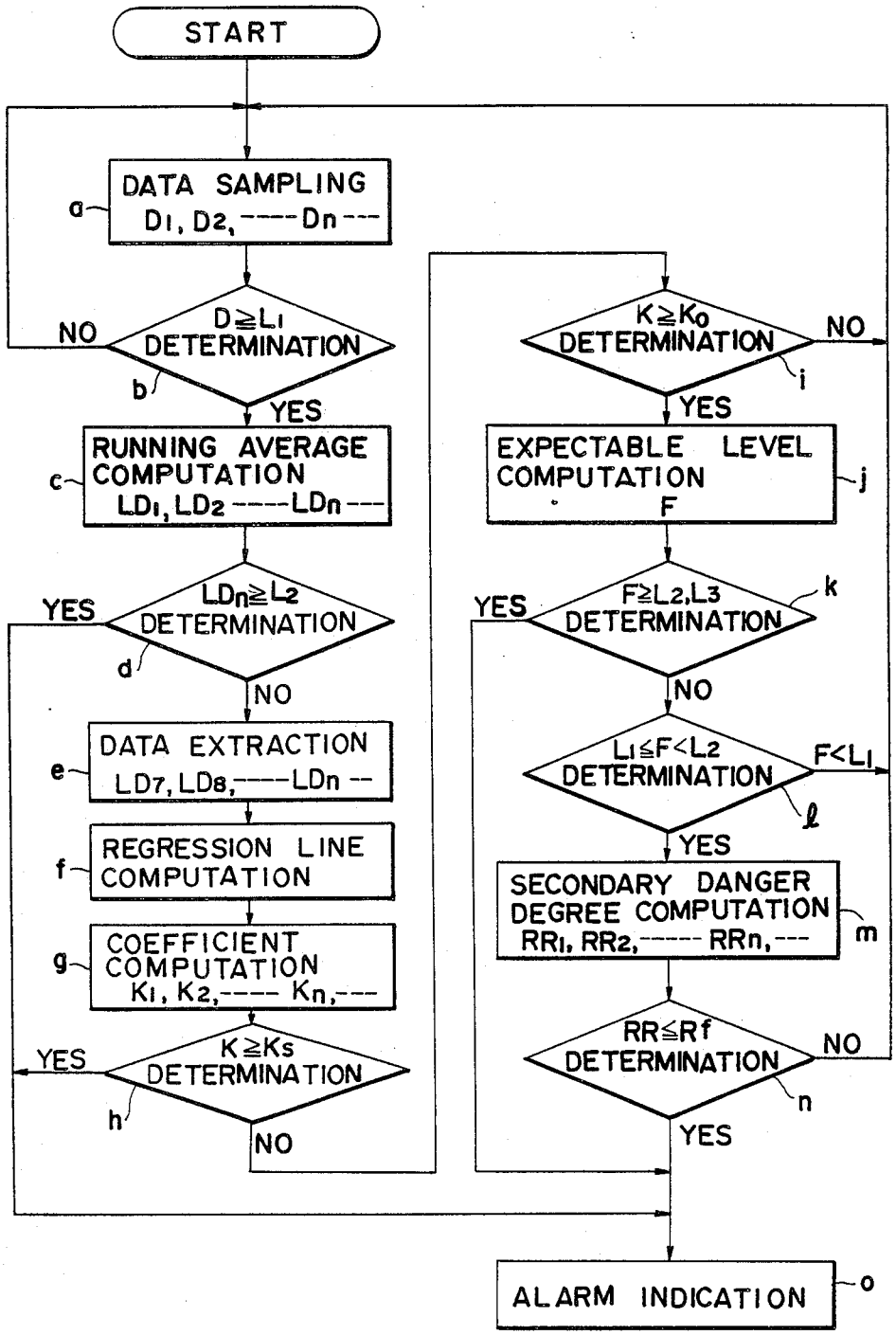
FIG. 21 is a flowchart for the fire determination in the embodiment of FIG. 18.

FIG. 21 is a flowchart to be used when a microcomputer is employed in the present embodiment, which is similar to that of the fourth embodiment as shown in FIG. 17. Here, only differences, i.e. blocks j, k and l will be described. At block j, an predictive level F is computed based on the regression line and at block k, the predicted level F is compared with the predetermined levels, i. e., the fire level L2 and the danger level L3. When it is determined that F≧L2 or F≧L3, the step proceeds to block o to effect the alarming indication. However, the two levels L2 and L3 can be treated as the same level. When F<L2, the step proceeds to block 1 and when F<L1, it is determined to be normal and the step is returned to block a. When L1≦F<L2, it is determined as being uncertain and the step proceeds to block m. However this block 1 can be omitted. The blocks m and n effect substantially the same computation and determination as in the fourth embodiment.

Figure 22:
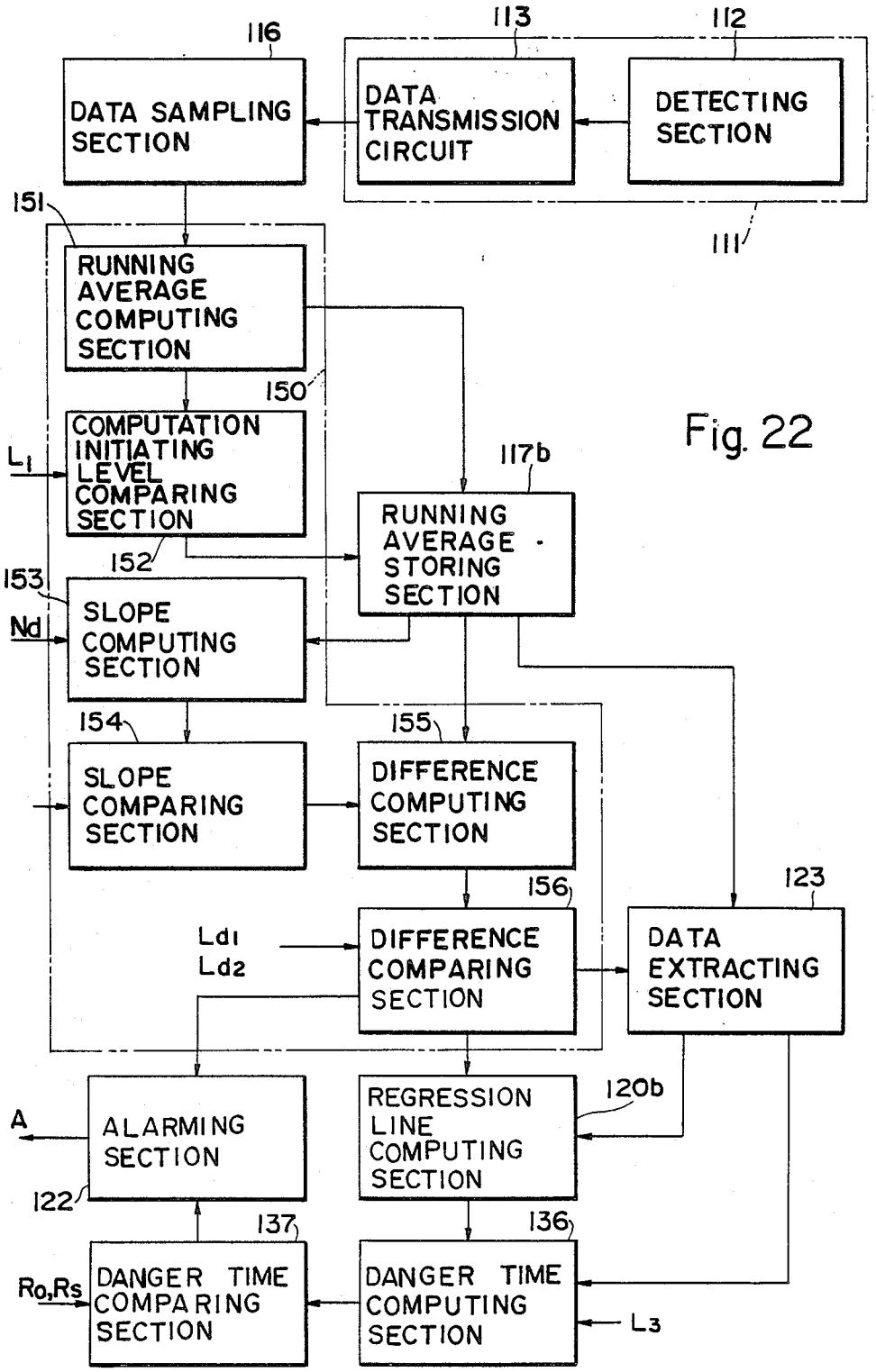
FIG. 22 is a block diagram of a sixth embodiment of the present invention.
Figure 23:
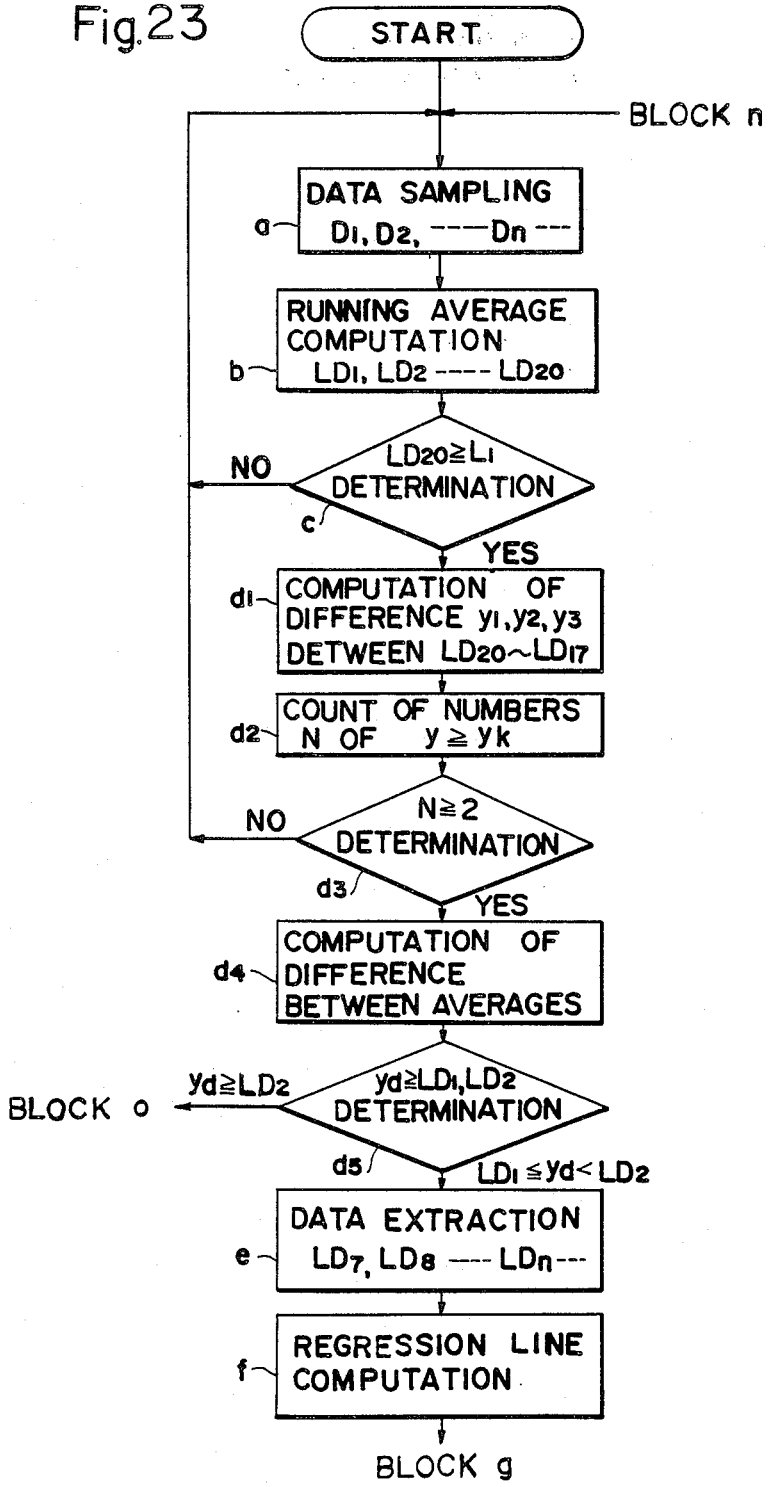
FIG. 23 is a partial flowchart for the fire determination in the sixth embodiment.
Figure 24:
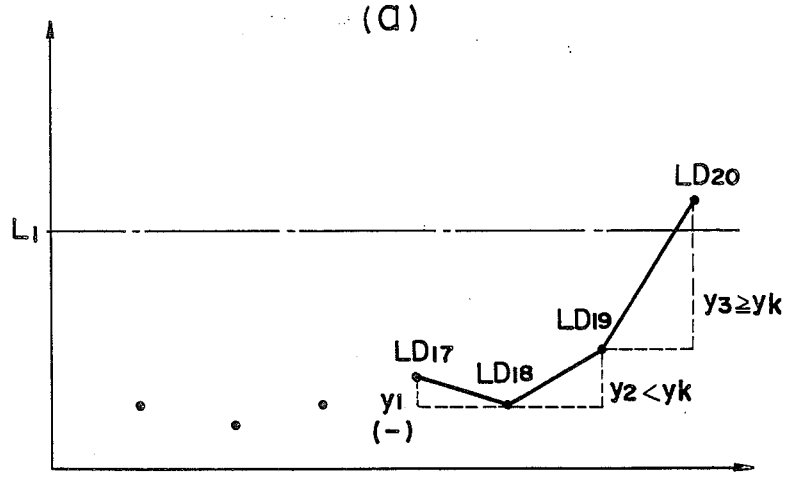
FIGS. 24 (*a*), (*b*) and (*c*) are graphs each showing the contents of the level determining section in the embodiment of FIG. 22.
Figure 24:
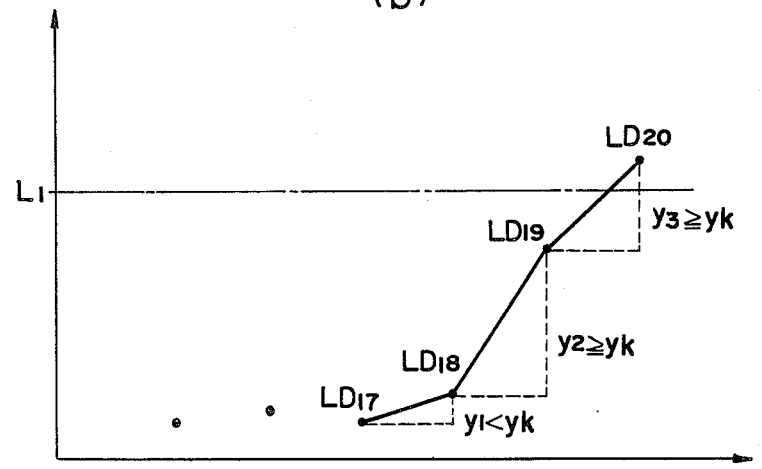
Figure 24:
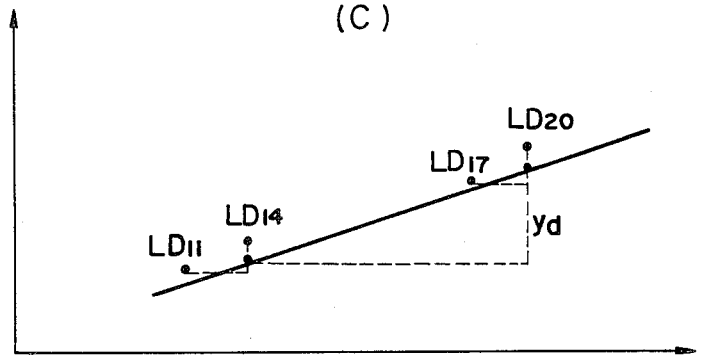

FIG. 22, FIG. 23 and FIGS. 24 (*a*), (*b*) and (*c*) illustrate a sixth embodiment of the present invention. The sixth embodiment utilizes differences between the respective data for the level determination of the data. It is apparent in comparison between FIG. 13 and FIG. 22 that an analog detector 111, a data sampling section 116, a regression line computing section 120*a*, and a danger degree computing section comprising a danger time computing section 136 and a danger time comparing section 137 are similar to those of the fourth embodiment. In the present embodiment, however, a storing section comprises only a running average storing section 117*b*. A secondary computing section 121 and a time indication section 138 which are indicated in FIG. 13 are not shown in the drawing but they may be employed according to necessity.

A level determining section 150 comprises a running average computing section 151, a computation initiating level comparing section 152, a slope computing section 153, a slope comparing section 154, a difference computing section 155 and a difference comparing section 156. In the present embodiment, the data processed at the data sampling section 116 are directly introduced into the running average computing section 51 and consecutive n number of running average LD1, Ld2 . . . LDn are sequentially stored for the respective detectors 111*a*, 111*b* . . . 111*n*. The latest running average LDn is compared with a preliminarily set computation initiating level L1 at the computation initiating level comparing section 152. When the average LDn exceeds the level L1, several number of data LDn, LDn−1, . . . including the latest running average LDn are supplied from the running average storing section 117*b* to the slope computing section 153 in response to a signal output from the computation initiating level comparing section 152.

The slope computing section 153 computes amounts of changes (ratio of value to time: slope) between the respective data LDn, LDn−1 . . . This results in computing the differences y1, y2, . . . between the respective data LDn, LDn−1 . . . since the computing intervals of the running averages LD are set to be constant (FIGS. 24(*a*) and (*b*)). The slope comparing section 154 counts the number N of the differences which exceed the predetermined value yk among the predetermined number of differences (slopes) and when the number N becomes Nd or more, it actuates the difference computing section 155.

The difference computing section 155 extracts a predetermined number of data, for example, data LDn to LD11 from the running average storing section 117*b* and computes how much the data values change within the period of time when these data are detected, i. e., differences yd between the data values (FIG. 24(*c*)). In this case, LDn and LDn−11 are not directly compared with each other, but an average between LDn and a bit earlier LDn−3 and an average between LDn−11 and a bit later LDn−9 are compared with each other for eliminating an influence of noises.

The differences computing section 155 outputs a signal to the regression line computing section 120*a* or the alarming section 122 for actuating the same when the difference yd between these two average values is larger than the two predetermined levels Ld1, Ld2. More particularly, the difference is checked to roughly determine whether it is a fire or not, and if it is apparently determined as a fire (yd≧Ld1), a signal is output directly to the alarming section 122 and if it is determined to need a further detailed check (Ld2≦yd<Ld1), computation is carried out by using a regression line.

FIG. 23 is a flow chart to be used when a microcomputer is employed in the present embodiment. Only differences from the flowchart as shown in FIG. 17 will be explained.

It is now assumed that data D1, D2 . . . are sampled at block a and the running averages are sequentially obtained at block b to obtain 20 running averages LD1, LD2, . . . LD20. At block d, the computation initiating level L1 is compared with the latest running average LD20 and when LD20≧L1, the step proceeds to block d1. At block d1, the differences y1, y2 and y3 between LD17 and LD18, LD18 and LD19 and LD19 and LD20, respectively, are computed. At block d2, the number of the differences which exceeds the predetermined value yk is counted and when the number N is two or more (block d3), the step proceeds to block d4. At block d4, the difference yd between the average between LD20 and LD17 and the average between LD14 and LD11 are computed and they are compared with the predetermined values Ld1 and Ld2 at block d5. When yd≧Ld1, the step proceeds to block o to make the alarm indication and when Ld1≦yd<Ld2, the step proceeds to blocks e and f to effect an estimation computation by the regression line.

FIG. 24(*a*) shows a state where only y3 is larger than yk and N<Nd=2 and it is determined there is no fire started. FIG. 24(*b*) shows a state where y2 and y3 are larger than yk and N=Nd=2 and it is determined there is a fear of a fire and the processing step should be advanced to later stages.

The sections of the system according to the present embodiment may comprise various electric and/or electronic circuits or may employ a microcomputer with its ROM storing appropriate programs. And detectors and the computing section can be united by employing a one-chip computer. The transmission circuit is not required in this situation.

We claim:

1. A fire alarm system which comprises:

one or more detecting sections for detecting a change in the physical phenomen of the surroundings related to the occurrence of a fire and outputting analog data corresponding to the change;

a data sampling section for sampling the data from each of the detecting sections at periodic intervals;

a storing section for storing the data output from the data sampling section for each of; said detecting sections;

a computing section for sequentially extracting the data from said storing section, computing from such data an approximation equation of said change, and computing a future value of said phenomen predicted from said approximation equation by using a predetermined number of the data stored in said storing section;

a comparing section for comparing said future value predicted by said computing section with a preliminarily set data value related to fire alarming and generating an output when the relation therebetween is not within a predetermined range; and an alarming section for generating an alarm in response to the output from said comparing section.

2. A fire alarm system according to claim 1, wherein the plurality of detecting sections are sampled sequentially to derive data therefrom and said storing section stores said data at addresses assigned to the respective detecting sections.

3. A fire alarm system which comprises:

one or more detecting sections for detecting a change in the physical phenomena of the surroundings related to occurrence of a fire and outputting analog data corresponding to said change;

a data sampling section for sampling the data from each of said detecting sections at periodic intervals;

a storing section for storing the data output from said data sampling section for each of said detecting sections;

a computing section for sequentially extracting the data from said storing section; computing a linear, quadratic or higher order approximation equation of said change; and computing a preestimated time at which a future value of said phenomena as predicted from said approximation equation will exceed a predetermined value, such computation being carried out by using a predetermined number of the data stored in said storing section;

a comparing section for comparing said preestimated time with a predetermined time interval and generating an output when the preestimated time is shorter than such predetermined time interval; and an alarming section for generating an alarm in response to the output from said comparing section.

4. A fire alarm system as claimed in claim 3, wherein said computing section carries out the computation of said preestimated time based on the values of the difference between the detection data at each sampling interval and the detection data at each preceding sampling interval.

5. A fire alarm system as claimed in claim 4, wherein said computing section compares, said difference value with a first and a second threshold level, outputs a cancelling signal for cancelling the detection data when said difference value is lower than the first threshold level, outputs a fire alarm signal when said difference value is above the second threshold level, and carries out a second computation, by a functional approximation method, when said difference value is higher than the first threshold level but lower than the second threshold level.

6. A fire alarm system as claimed in claim 3, wherein said computing section carries out the computation and preestimation based on a regression line obtained from the plural sampling date by approximation.

7. A fire alarm system as claimed in claim 3, wherein said computing section carries out the computation and preestimation based on a regression curve obtained from the plural sampling date by approximation.

8. A fire alarm system as claimed in claim 3, in which the computing section computes and preestimates from the detection data of plural kinds of physical phenomena which are caused to change by a fire, the times required for such phenomena to reach predetermined danger levels, and when such times are shorter than preset times for escape the comparing section generates an output to said alarming system to cause it to generate an alarm.

9. A fire alarm system as claimed in claim 8, further comprising a logical determining circuit for establishing said predetermined danger levels and a further fire danger level such that irrespective of said computation and preestimation, when the detection data exceeds said fire danger level the computing section generates an output to said alarming section to cause it to generate an alarm.

10. A fire alarm system as claimed in claim 3 wherein said computing circuit section is adapted to compare the periodically sampled detection data with a computation-initiating level so as to initiate the computation and preestimation only when said detection data exceed said computation-initiating level.

11. A fire alarm system according to claim 3 wherein said computing section comprises:

a first level comparing section for generating an output signal when said output data from said data sampling section exceeds a predetermined computation initiating level;

a running average computing section for extracting a predetermined number of data from said storing section by the output from said first level comparing section and computing running averages;

a running average storing section for sequentially storing the computation results of said running average computing section; and a second level comparing section for outputting a signal for actuating said first computing section when said computation results of said running average computing section exceeds a predetermined level;

said first computing section being adapted to compute a regression line based on a predetermined number of running averages, and to determine said predetermined time on the basis of such regression line.

12. A fire alarm system according to claim 11, wherein said first level comparing section generates an output when a predetermined number of output data from said data sampling section successively exceed the predetermined computation initiating level.

13. A fire alarm system according to claim 11, wherein said second level comparing section comprises a difference computing section for computing differences between a plurality of computed running averages by said running average computing section and a difference comparing section for outputting a signal for actuating said first computing section when said computed differences exceed a predetermined value.

14. A fire alarm system according to claim 13, wherein said first level comparing section generates an output when a predetermined number of output data from said data sampling section successively exceed the predetermined computation initiating level.

15. A fire alarm system which comprises:

one or more detecting sections for detecting a change in the physical phenomena of the surroundings related to the occurrence of a fire and outputting analog data corresponding to the change;

a data sampling section for sampling the data from each of said detecting sections at periodic intervals;

a storing section for storing the data output from said data sampling section for each of said detecting sections; and a computing section for sequentially extracting the data from said storing section; computing a linear, quadratic or higher order approximation equation of said change; and computing a future value of said phenomena after a predetermined time has passed, such computation being carried out by use of a regression line determined from a predetermined number of the data stored in said storing section;

a comparing section for comparing said future values of said phenomena with predetermined values thereof and generating an output when any of such future values exceeds the corresponding predetermined value; and an alarming section for generating an alarm in response to the output from said comparing section.

16. A fire alarm system as claimed in claim 15, wherein said computing section carries out the computation and preestimation based on a regression line obtained from the plural sampling data by approximation.

17. A fire alarm system as claimed in claim 15, wherein said computing section derives a difference value from the detection data and compares it with a first and second threshold level; outputs a cancelling signal for cancelling the detection data when the difference value is lower than the first threshold level; outputs a fire alarm signal when the difference value is above the second threshold level; and carries out a second computation, by the functional apprximation method, when the difference value is higher than the first threshold level but lower than the second threshold level.

18. A fire alarm system according to claim 15, which further comprises a level determining section provided between said storing section and said first computing section for outputting a signal for actuating said computing section when the output data from said data sampling section exceeds a predetermined computation initiating level.

19. A fire alarm system according to claim 15, wherein said computing section comprises:

a first comparing section for generating an output signal when the output data from said data sampling section exceeds the predetermined computation initiating level;

a running average computing section for extracting a predetermined number of data from said storing section by the output from said first comparing section and computing running averages;

a running average storing section for sequentially storing the computation result of said running average computing section; and a level comparing section for outputting a signal for actuating said first computing section when computation result of said running average computing section exceeds the predetermined level;

said first computing section being adapted to compute regression lines based on a predetermined number of running averages, and to determine said predetermined time on the basis of said regression lines.

20. A fire alarm system according to claim 19, wherein said first level comparing section generates an output signal when a predetermined number of output data from said data sampling section successively exceed the predetermined computation initiating level.

21. A fire alarm system according to claim 19, wherein said second level comparing section comprises a difference computing section for computing differences between a plurality of running averages computed by said running average computing section and a difference comparing section for outputting a signal for actuating said first computing section when the computed differences exceed a predetermined value.

22. A fire alarm system according to claim 21, wherein said first level comparing section generates an output signal when a predetermined number of output signal from said data sampling section successively exceed the predetermined computation initiating level.

* * * * *